US010905206B1

(12) United States Patent
Tashjian

(10) Patent No.: US 10,905,206 B1
(45) Date of Patent: Feb. 2, 2021

(54) PIERCING TECHNIQUES, EARRINGS THEREFOR, AND METHODS OF MANUFACTURE AND USE THEREOF

(71) Applicant: Venus by Maria Tash, Inc., New York, NY (US)

(72) Inventor: Maria Tashjian, New York, NY (US)

(73) Assignee: Venus by Maria Tash, Inc., New York, NY (US)

( * ) Notice: Subject to any disclaimer, the term of this patent is extended or adjusted under 35 U.S.C. 154(b) by 0 days.

(21) Appl. No.: 17/013,826

(22) Filed: Sep. 7, 2020

Related U.S. Application Data

(63) Continuation-in-part of application No. 29/749,236, filed on Sep. 3, 2020, and a continuation-in-part of application No. 29/725,811, filed on Feb. 27, 2020.

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/001; A44C 7/00
USPC ..... 606/188
See application file for complete search history.

(56) References Cited

U.S. PATENT DOCUMENTS

| | | | | |
|---|---|---|---|---|
| 20,480 A | | 6/1858 | Carpenter | |
| 130,771 A | | 8/1872 | Tryner | |
| 292,810 A | | 2/1884 | Hartmann | |
| D32,523 S | | 4/1900 | Zell | |
| D136,958 S | | 10/1943 | Rubel | |
| D137,112 S | | 10/1943 | Rubel | |
| D139,254 S | | 8/1944 | Philippe | |
| 2,410,914 A | * | 11/1946 | Williams | A44C 7/00 63/14.2 |
| D150,589 S | | 9/1947 | Katz | |
| D150,612 S | | 10/1947 | Katz | |
| D151,171 S | | 1/1948 | Philippe | |
| D154,608 S | | 1/1949 | Katz | |
| D156,271 S | | 7/1949 | Philippe | |
| D156,312 S | | 8/1949 | Bogoff | |
| D159,118 S | | 2/1950 | Weinberg | |
| 2,502,386 A | | 3/1950 | Mailand | |
| D161,286 S | | 9/1950 | Semensohn | |
| D161,289 S | | 9/1950 | Semensohn | |
| D162,461 S | | 12/1950 | Philippe | |
| D164,946 S | | 7/1951 | Philippe | |
| D169,726 S | | 1/1953 | Bell | |

(Continued)

OTHER PUBLICATIONS

Blue Buddha Boutique, Cre8time Movement: Jewelry Project in 8 steps of Less—Coiled Earrings, http://www.bluebuddhaboutique.com/blog/2013/04/cre8tirne-rnovement-jewelry-project-in-8-steps-or-less-coiled-earrings/, Apr. 6, 2013 (6 pages).

(Continued)

*Primary Examiner* — Jack W Laviner
(74) *Attorney, Agent, or Firm* — Dentons US LLP

(57) ABSTRACT

This disclosure enables various piercing techniques, earrings therefor, and methods of manufacture and use thereof. In particular, these technologies can preclude a bystander from readily comprehending how an earring is attached to an ear of a wearer when the bystander views the ear of the wearer frontally straight-on. This preclusion occurs by providing a floating effect for the earring based on where the ear is pierced and how the earring is structured.

27 Claims, 92 Drawing Sheets

The Drape Piercing can be done in the upper conch of the ear hidden by the inferior crus of the antihelix, or in the bowl of the helix. To execute the helix piercing, the upper helix tissue is lifted and the needle is placed underneath. This is referred to as the Tash Helix. To execute the conch piercing, the tissue of the inferior crus of the antihelix is lifted and the needle is placed underneath, in the upper conch. This is referred to as the Tash Hidden Rook

(56) References Cited

U.S. PATENT DOCUMENTS

D170,349 S 5/1953 Bell
D170,266 S 6/1953 Katz
D171,728 S 11/1953 Philippe
D171,708 S 3/1954 Katz
D173,990 S 2/1955 Katz
D176,782 S 1/1956 Katz
D177,121 S 3/1956 Katz
D187,812 S 5/1960 Randall
3,382,589 A 5/1968 Dowling
3,844,271 A * 10/1974 Lake ..... H04R 25/60 128/898
3,958,353 A * 5/1976 Hayes ..... A01K 11/001 40/301
3,965,602 A * 6/1976 Whitney ..... A01K 11/001 40/301
D242,670 S 12/1976 Northup
D244,126 S 4/1977 Ladjimi
D244,920 S 7/1977 Kelman
D245,650 S 9/1977 Mueller et al.
D246,357 S 11/1977 Durante
D247,614 S 3/1978 Kelman
D248,380 S 7/1978 Burchett
D248,458 S 7/1978 Gatof et al.
D248,801 S 8/1978 Tafoya
D249,129 S 8/1978 Fishman
D249,130 S 8/1978 Fishman
D249,252 S 9/1978 Gatof
D249,337 S 9/1978 DiOrio
4,121,591 A * 10/1978 Hayes ..... A01K 11/002 227/144
D250,456 S 12/1978 Fishman
D250,457 S 12/1978 Fishman
D250,516 S 12/1978 Fishman
D250,517 S 12/1978 Fishman
D251,715 S 5/1979 Fishman
D255,670 S 7/1980 Ambler
D255,885 S 7/1980 Andrews
D256,003 S 7/1980 Barr
D257,023 S 9/1980 Barr
D257,024 S 9/1980 Barr
D257,026 S 9/1980 Barr
D259,110 S 5/1981 Russell
D260,622 S 9/1981 Barr
D260,744 S 9/1981 Barr
D261,245 S 10/1981 Epstein
D261,246 S 10/1981 Epstein
D261,247 S 10/1981 Epstein
D261,372 S 10/1981 Fried
D262,272 S 12/1981 Block
D264,060 S 4/1982 Epstein
D265,641 S 8/1982 Bongiorno
D265,811 S 8/1982 Barr
D265,894 S 8/1982 Barr
D265,895 S 8/1982 Barr
D267,241 S 12/1982 Bulgari
D268,016 S 2/1983 Block
D271,952 S 12/1983 Altman
D272,327 S 1/1984 Bulgari
D272,994 S 3/1984 Serapiglia
D273,371 S 4/1984 Bulgari
D273,472 S 4/1984 Goldstein
D274,418 S 6/1984 Bruce
D274,709 S 7/1984 Bulgari
D278,987 S 5/1985 Zauderer
D279,082 S 6/1985 Bulgari
D279,874 S 7/1985 Moon
D279,875 S 7/1985 Moon
D279,876 S 7/1985 Moon
D279,877 S 7/1985 Moon
D279,878 S 7/1985 Moon
D279,879 S 7/1985 Moon
D279,880 S 7/1985 Moon
D279,881 S 7/1985 Moon
D279,882 S 7/1985 Moon
D279,883 S 7/1985 Moon
D279,884 S 7/1985 Moon
D279,885 S 7/1985 Moon
4,538,429 A 9/1985 Bradford
D281,149 S 10/1985 Krogh
D281,767 S 12/1985 Mason
D282,647 S 2/1986 Bulgari
D283,205 S 4/1986 Stephenson
D284,952 S 8/1986 Ricks
4,612,877 A * 9/1986 Hayes ..... A01K 11/006 119/655
D286,758 S 11/1986 Bulgari
D287,230 S 12/1986 Bulgari
D287,231 S 12/1986 Copeland
D287,577 S 1/1987 Lorberfeld
D290,446 S 6/1987 Bulgari
4,688,400 A 8/1987 Chioffe
D292,501 S 10/1987 Jones
D292,560 S 11/1987 Di Maria et al.
D292,685 S 11/1987 Bulgari
D292,686 S 11/1987 Bulgari
D292,687 S 11/1987 Pesonen
D292,780 S 11/1987 Galask
D293,899 S 1/1988 Bulgari
D294,473 S 3/1988 Bulgari
D294,684 S 3/1988 Saraga
D295,151 S 4/1988 Saraga
D295,267 S 4/1988 Saraga
D298,611 S 11/1988 Saraga
D301,120 S 5/1989 Alviti
D301,314 S 5/1989 Shapiro
D301,561 S 6/1989 Westmoland
D301,562 S 6/1989 Gaskill
D302,252 S 7/1989 Sykes
D302,400 S 7/1989 Bulgari
D302,401 S 7/1989 Weingast
D303,230 S 9/1989 Westmoland
D303,999 S 10/1989 Hansson
D304,433 S 11/1989 McConnell, Jr.
D304,532 S 11/1989 Campbell
D304,533 S 11/1989 Campbell
D305,311 S 1/1990 Roberts
D305,996 S 2/1990 Bulgari
D307,989 S 5/1990 Stewart
D308,027 S 5/1990 Bulgari
D308,179 S 5/1990 Perlmutter et al.
D308,180 S 5/1990 Bulgari
D308,348 S 6/1990 Leopoldi
D308,349 S 6/1990 Bulgari
D308,650 S 6/1990 Bulgari
D308,651 S 6/1990 Bulgari
D308,652 S 6/1990 Bulgari
D308,838 S 6/1990 Bulgari
D308,949 S 7/1990 Bulgari
D308,950 S 7/1990 Greenhouse
D309,879 S 8/1990 Bulgari
D310,926 S 10/1990 Bass et al.
D310,979 S 10/1990 Perry
D311,502 S 10/1990 Bulgari
D313,202 S 12/1990 Bulgari
D313,370 S 1/1991 Steiner
D315,211 S 3/1991 Reil
D315,248 S 3/1991 Marshall
D315,654 S 3/1991 Hummel
D317,095 S 5/1991 Albers et al.
D317,422 S 6/1991 Hardy
D318,197 S 7/1991 Butler
D319,801 S 9/1991 Bulgari
D320,573 S 10/1991 Bulgari
D320,798 S 10/1991 Holt
D320,799 S 10/1991 Holt
D320,951 S 10/1991 Bulgari
D321,149 S 10/1991 Royer
D321,150 S 10/1991 Bulgari
D322,890 S 1/1992 Drews
D324,350 S 3/1992 Owens, Jr.
D324,871 S 3/1992 Cordet et al.
D325,542 S 4/1992 Rubin et al.
D325,543 S 4/1992 Gueit
D326,066 S 5/1992 Sprague

(56) References Cited

U.S. PATENT DOCUMENTS

D326,429 S 5/1992 Azrielant
D326,430 S 5/1992 Ortega
D326,595 S 6/1992 Badgerow et al.
D326,828 S 6/1992 Bulgari
D327,030 S 6/1992 Young
D327,850 S 7/1992 Reil
D327,982 S 7/1992 Williams
D329,341 S 9/1992 Rhodes
D329,565 S 9/1992 Kane et al.
D330,872 S 11/1992 Ball
5,161,391 A 11/1992 Lorberfeld
D331,891 S 12/1992 Foley
D332,025 S 12/1992 Caldwell et al.
D333,279 S 2/1993 Fryklund
D334,003 S 3/1993 Vogelsang
D334,004 S 3/1993 Mandelbaum
D334,010 S 3/1993 Mandelbaum
D334,153 S 3/1993 Mandelbaum
D334,353 S 3/1993 Lorberfeld
D334,855 S 4/1993 Harrington et al.
D335,959 S 6/1993 Blake
D335,995 S 6/1993 Soles
D336,574 S 6/1993 Rhodes
D336,621 S 6/1993 Vogelsang
D337,741 S 7/1993 Garfolo
D337,910 S 8/1993 Paluba
D337,963 S 8/1993 Gladorisi
D338,117 S 8/1993 Caldwell et al.
D339,310 S 9/1993 Azrielant
D342,691 S 12/1993 Milgrom
D342,894 S 1/1994 DiDomenico
D343,535 S 1/1994 Scott
D343,749 S 2/1994 Thompson
D344,910 S 3/1994 Nelson
D345,051 S 3/1994 Wills
D346,343 S 4/1994 Haugh
D347,801 S 6/1994 Church
D348,023 S 6/1994 Horner et al.
D348,854 S 7/1994 Salsgiver
D348,997 S 7/1994 Menner
D350,027 S 8/1994 Downes et al.
D352,190 S 11/1994 Tucker
5,363,675 A 11/1994 Carter
D353,120 S 12/1994 Pandel
D353,501 S 12/1994 Kral
D354,016 S 1/1995 Schubert
D354,927 S 1/1995 Andrau
D356,751 S 3/1995 Gross et al.
D358,067 S 5/1995 Graves
D358,210 S 5/1995 Reil
D359,254 S 6/1995 Gross et al.
D359,705 S 6/1995 Ball
D359,706 S 6/1995 DeAngelis
D361,451 S 8/1995 Reiland
D362,821 S 10/1995 Marchessault
D363,218 S 10/1995 Mann
D363,602 S 10/1995 Asher
D363,683 S 10/1995 Spurgeon et al.
D365,779 S 1/1996 Archambeault
D366,729 S 1/1996 Reil
D367,384 S 2/1996 DiFranco et al.
D368,671 S 4/1996 Ross
D370,372 S 6/1996 Kraft
D370,866 S 6/1996 Lange
D371,754 S 7/1996 Dunham
D371,982 S 7/1996 Price
D372,312 S 7/1996 Lange
D372,380 S 8/1996 Montalbo et al.
D373,742 S 9/1996 Janice
D374,637 S 10/1996 Esser
D374,837 S 10/1996 Austin
D375,703 S 11/1996 Lowe et al.
D376,335 S 12/1996 Shechter
D376,476 S 12/1996 Tepen et al.
D376,768 S 12/1996 Ross
5,588,309 A 12/1996 Chioffe
D377,461 S 1/1997 Kloppenburg, Jr. et al.
D378,360 S 3/1997 Montaquila
D378,808 S 4/1997 Shechter
D379,305 S 5/1997 VanFleet
D379,601 S 6/1997 Itzkowitz
D380,978 S 7/1997 Matye
D381,925 S 8/1997 Bergannini
5,660,061 A 8/1997 Magida
D383,699 S 9/1997 Bulgari
D383,700 S 9/1997 Bulgari
D383,706 S 9/1997 Archambault
D383,998 S 9/1997 Condron
D385,814 S 11/1997 Kilpatrick
D386,108 S 11/1997 Montaquila
D386,439 S 11/1997 Itzkowitz
D386,711 S 11/1997 Matye
D388,011 S 12/1997 Leonard
D388,012 S 12/1997 Matye
D388,013 S 12/1997 Rich
D388,357 S 12/1997 Montaquila
D388,734 S 1/1998 Montaquila
D388,735 S 1/1998 Webber
D389,085 S 1/1998 Montaquila
D389,424 S 1/1998 Montaquila
D389,775 S 1/1998 Bulgari
D389,776 S 1/1998 Montaquila
D390,151 S 2/1998 Blum et al.
D390,802 S 2/1998 Bulgari
D391,516 S 3/1998 Kothari
D391,756 S 3/1998 Home
D391,887 S 3/1998 Barr
D391,888 S 3/1998 Fox
D392,041 S 3/1998 Reil
D392,042 S 3/1998 Reil
D392,206 S 3/1998 Kothari
D393,604 S 4/1998 Webber
D393,812 S 4/1998 Silveri
D394,021 S 5/1998 Matye
D394,769 S 6/1998 Flint
D394,821 S 6/1998 Montaquila
D394,823 S 6/1998 Vos
D398,875 S 9/1998 Kothari
D398,876 S 9/1998 Kothari
5,827,212 A * 10/1998 Gaskill ..... A61F 5/05891 602/53
D401,182 S 11/1998 Bulgari
D401,486 S 11/1998 Becker
D401,884 S 12/1998 Gruosi
D406,544 S 3/1999 Leonard
D407,344 S 3/1999 Dubnicka
D408,315 S 4/1999 Lavalais
D408,317 S 4/1999 Karmeli
D410,589 S 6/1999 Lagergren
D413,830 S 9/1999 Moten
D415,446 S 10/1999 Kattan
D417,636 S 12/1999 Ambar
D418,079 S 12/1999 Porcell
D419,908 S 2/2000 Leonard
D420,304 S 2/2000 Porcell
D420,934 S 2/2000 Montaquila
6,053,931 A * 4/2000 Lizcano ..... A44C 7/001 606/188
D423,979 S 5/2000 Montaquila
D424,468 S 5/2000 Bergagnini
D424,695 S 5/2000 Reil
D427,540 S 7/2000 Calvani
D429,658 S 8/2000 Biagi
D430,815 S 9/2000 Montaquila
D434,877 S 12/2000 Harral
D435,476 S 12/2000 Gruosi
D436,727 S 1/2001 Hsu
D439,190 S 3/2001 Itzkowitz
D439,193 S 3/2001 Gruosi
D441,313 S 5/2001 Turner
D450,615 S 11/2001 Ambar
D454,810 S 3/2002 Knee
D455,974 S 4/2002 Torres
D458,182 S 6/2002 Gruosi

(56) References Cited

U.S. PATENT DOCUMENTS

| | | | |
|---|---|---|---|
| D461,409 | S | 8/2002 | Kardush |
| D468,494 | S | 1/2003 | Holloway |
| D472,497 | S | 4/2003 | Bonnet |
| D474,353 | S | 5/2003 | Gist Skinner |
| D479,145 | S | 9/2003 | Newman |
| D481,326 | S | 10/2003 | Bonifacio |
| D481,646 | S | 11/2003 | Bonifacio |
| D484,822 | S | 1/2004 | Crova |
| D485,203 | S | 1/2004 | Pachachi |
| D485,204 | S | 1/2004 | Sandberg |
| D486,091 | S | 2/2004 | Pachachi |
| D486,416 | S | 2/2004 | Pachachi |
| D487,408 | S | 3/2004 | Coin |
| D489,639 | S | 5/2004 | Castle |
| D506,406 | S | 6/2005 | Sandberg |
| D507,985 | S | 8/2005 | Sandberg |
| D511,310 | S | 11/2005 | Gruosi |
| D513,392 | S | 1/2006 | Arbore |
| D515,452 | S | 2/2006 | Arbore |
| D516,453 | S | 3/2006 | Kayamori et al. |
| D520,897 | S | 5/2006 | Sandberg |
| D531,078 | S | 10/2006 | Chan |
| D533,803 | S | 12/2006 | Corso |
| D535,580 | S | 1/2007 | Arbore |
| D537,377 | S | 2/2007 | Becker |
| D537,750 | S | 3/2007 | Allin |
| D537,751 | S | 3/2007 | Becker |
| D538,195 | S | 3/2007 | Williams |
| D538,701 | S | 3/2007 | Williams |
| D539,690 | S | 4/2007 | Allin |
| D540,212 | S | 4/2007 | Becker |
| D541,694 | S | 5/2007 | Ping |
| D542,170 | S | 5/2007 | Bruno et al. |
| D542,696 | S | 5/2007 | Cilluffo |
| 7,217,014 | B2 | 5/2007 | Nielson |
| D544,389 | S | 6/2007 | Ooten |
| D545,716 | S | 7/2007 | Bulgari |
| D549,125 | S | 8/2007 | Malone |
| D549,607 | S | 8/2007 | Mouclier |
| D550,583 | S | 9/2007 | Karachi-Langane |
| D554,020 | S | 10/2007 | Bruno et al. |
| D555,030 | S | 11/2007 | Hardy |
| D556,620 | S | 12/2007 | Chan |
| D562,718 | S | 2/2008 | Wong |
| D567,132 | S | 4/2008 | Bulgari |
| D567,133 | S | 4/2008 | Crawford |
| D567,134 | S | 4/2008 | Bulgari |
| D567,702 | S | 4/2008 | Walters |
| D574,745 | S | 8/2008 | Nolan |
| D574,746 | S | 8/2008 | Nolan |
| D588,490 | S | 3/2009 | Momjian |
| D591,192 | S | 4/2009 | Nolan |
| D592,538 | S | 5/2009 | Momjian |
| D599,694 | S | 9/2009 | Nolan |
| D599,695 | S | 9/2009 | Nolan |
| D600,586 | S | 9/2009 | Nolan |
| D601,056 | S | 9/2009 | Atallah |
| D601,917 | S | 10/2009 | Nolan et al. |
| D603,289 | S | 11/2009 | Lebail |
| D605,968 | S | 12/2009 | Colombani |
| D605,970 | S | 12/2009 | Colombani |
| D606,443 | S | 12/2009 | Traglio |
| D606,896 | S | 12/2009 | Traglio |
| D607,363 | S | 1/2010 | Traglio |
| D607,364 | S | 1/2010 | Marks |
| D608,239 | S | 1/2010 | McCarty-O'Brien |
| D610,033 | S | 2/2010 | Colombani |
| D610,934 | S | 3/2010 | Papadimitriou |
| D610,935 | S | 3/2010 | Papadimitriou |
| D614,073 | S | 4/2010 | Cabarbaye |
| D619,030 | S | 7/2010 | Papadimitriou |
| D619,488 | S | 7/2010 | Gruosi |
| D620,833 | S | 8/2010 | Papadimitriou |
| D621,279 | S | 8/2010 | Janssen |
| D621,281 | S | 8/2010 | Janssen |
| D621,721 | S | 8/2010 | Walker-Spry |
| D623,081 | S | 9/2010 | Papadimitriou |
| D624,843 | S | 10/2010 | Colombani |
| D626,881 | S | 11/2010 | Meneau |
| D627,252 | S | 11/2010 | Warren |
| D627,253 | S | 11/2010 | Meneau |
| D628,113 | S | 11/2010 | Papadimitriou |
| D628,114 | S | 11/2010 | Papadimitriou |
| D629,325 | S | 12/2010 | Papadimitriou |
| D630,965 | S | 1/2011 | Papadimitriou |
| D630,967 | S | 1/2011 | Lebail |
| D631,383 | S | 1/2011 | Papadimitriou |
| D631,384 | S | 1/2011 | Papadimitriou |
| D631,385 | S | 1/2011 | Lebail |
| D632,605 | S | 2/2011 | Marchand |
| D634,214 | S | 3/2011 | Janssen |
| D635,608 | S | 4/2011 | Gray |
| D636,696 | S | 4/2011 | Lebail |
| D637,103 | S | 5/2011 | Lebail |
| D637,104 | S | 5/2011 | Papadimitriou |
| D639,692 | S | 6/2011 | Papadimitriou |
| D639,694 | S | 6/2011 | Papadimitriou |
| D640,585 | S | 6/2011 | Nolan |
| D642,086 | S | 7/2011 | Modi |
| 7,980,095 | B1 | 7/2011 | Masterson |
| D647,421 | S | 10/2011 | Nolan |
| D648,242 | S | 11/2011 | Hara |
| D653,151 | S | 1/2012 | Bennett |
| D655,193 | S | 3/2012 | Janssen |
| D658,090 | S | 4/2012 | Papadimitriou |
| D658,529 | S | 5/2012 | Papadimitriou |
| D658,530 | S | 5/2012 | Papadimitriou |
| D659,583 | S | 5/2012 | Papadimitriou |
| D660,743 | S | 5/2012 | Crafton |
| D660,744 | S | 5/2012 | Papadimitriou |
| D660,745 | S | 5/2012 | Papadimitriou |
| D661,219 | S | 6/2012 | Papadimitriou |
| D662,005 | S | 6/2012 | Bennett |
| D664,061 | S | 7/2012 | Papadimitriou |
| D664,062 | S | 7/2012 | Papadimitriou |
| D665,297 | S | 8/2012 | Parris |
| D665,298 | S | 8/2012 | Papadimitriou |
| D665,693 | S | 8/2012 | Bennett |
| D668,986 | S | 10/2012 | Friedman |
| D669,386 | S | 10/2012 | Papadimitriou |
| D669,387 | S | 10/2012 | Kwon |
| D670,191 | S | 11/2012 | Bennett |
| D671,439 | S | 11/2012 | Bennett |
| D672,681 | S | 12/2012 | Bennett |
| D673,070 | S | 12/2012 | Papadimitriou |
| D674,719 | S | 1/2013 | Bennett |
| D674,720 | S | 1/2013 | Bennett |
| D676,349 | S | 2/2013 | Papadimitriou |
| D678,101 | S | 3/2013 | Parvex |
| D680,024 | S | 4/2013 | Le Bail |
| D684,085 | S | 6/2013 | Papadimitriou |
| D689,392 | S | 9/2013 | Parvex |
| D692,261 | S | 10/2013 | Sharp |
| D692,342 | S | 10/2013 | Bennett |
| D693,260 | S | 11/2013 | Papadimitriou |
| D693,721 | S | 11/2013 | Papadimitriou |
| D694,146 | S | 11/2013 | Beeson |
| D703,084 | S | 4/2014 | Parvex |
| D707,151 | S | 6/2014 | Kimbrough et al. |
| D707,152 | S | 6/2014 | Shields |
| D708,540 | S | 7/2014 | Norendzayan |
| D708,541 | S | 7/2014 | Norendzayan |
| D709,792 | S | 7/2014 | Singer et al. |
| 8,763,357 | B1 | 7/2014 | Arnone |
| D714,673 | S | 10/2014 | Bradley |
| D716,685 | S | 11/2014 | Oh |
| D718,649 | S | 12/2014 | Harel-Klein et al. |
| D718,650 | S | 12/2014 | Weems |
| D720,647 | S | 1/2015 | Kwon |
| D722,907 | S | 2/2015 | Miceli |
| D726,577 | S | 4/2015 | Weems |
| D727,773 | S | 4/2015 | Kwon |
| D727,774 | S | 4/2015 | Kwon |
| D727,775 | S | 4/2015 | Yatsugi-Kang |

(56) References Cited

U.S. PATENT DOCUMENTS

| | | | |
|---|---|---|---|
| D727,776 | S | 4/2015 | Weems |
| D727,778 | S | 4/2015 | Levinson et al. |
| D728,410 | S | 5/2015 | Yatsugi-Kang |
| D729,107 | S | 5/2015 | Riviere |
| D729,108 | S | 5/2015 | Kwon |
| D731,347 | S | 6/2015 | Zeuner |
| D733,574 | S | 7/2015 | Walker-Spry |
| D737,717 | S | 9/2015 | Weems |
| D738,774 | S | 9/2015 | Vartanian |
| D738,775 | S | 9/2015 | Vartanian |
| D740,153 | S | 10/2015 | Vartanian |
| D740,154 | S | 10/2015 | Vartanian |
| D742,779 | S | 11/2015 | Traglio |
| D743,293 | S | 11/2015 | Weems |
| D746,719 | S | 1/2016 | Weems |
| D747,665 | S | 1/2016 | Hooper |
| D747,666 | S | 1/2016 | Yatsugi-Kang |
| D748,003 | S | 1/2016 | Vartanian |
| D748,004 | S | 1/2016 | Vartanian |
| D748,005 | S | 1/2016 | Vartanian |
| D748,006 | S | 1/2016 | Vartanian |
| D748,522 | S | 2/2016 | Vartanian |
| D748,524 | S | 2/2016 | Vartanian |
| D748,525 | S | 2/2016 | Tatsugi-Kang |
| D749,456 | S | 2/2016 | Gruosi |
| D749,978 | S | 2/2016 | Holubar |
| D749,981 | S | 2/2016 | Vartanian |
| D751,451 | S | 3/2016 | Kwon |
| D752,472 | S | 3/2016 | Riviere |
| D753,012 | S | 4/2016 | Yatsugi-Kang |
| D753,015 | S | 4/2016 | Crafton et al. |
| D753,533 | S | 4/2016 | Roth |
| D758,911 | S | 6/2016 | Kwon |
| D760,110 | S | 6/2016 | Miller |
| D760,618 | S | 7/2016 | Yatsugi-Kang |
| D761,658 | S | 7/2016 | Walker-Spry |
| D763,720 | S | 8/2016 | Yatsugi-Kang |
| D764,342 | S | 8/2016 | Bulgari |
| D764,343 | S | 8/2016 | Bulgari |
| D772,099 | S | 11/2016 | Roth |
| D778,200 | S | 2/2017 | Iacomucci |
| D780,034 | S | 2/2017 | Kwon |
| D780,036 | S | 2/2017 | Silvestri |
| D780,037 | S | 2/2017 | Magallanes-Leal |
| D780,038 | S | 2/2017 | Riviere |
| D780,039 | S | 2/2017 | Abdourahim |
| D780,040 | S | 2/2017 | Galli |
| D781,739 | S | 3/2017 | Nickels |
| D782,934 | S | 4/2017 | Riviere |
| D783,442 | S | 4/2017 | Yatsugi-Kang |
| D784,846 | S | 4/2017 | Abdourahim |
| D785,491 | S | 5/2017 | Yatsugi-Kang |
| D789,826 | S | 6/2017 | Riviere |
| D792,266 | S | 7/2017 | Hardy |
| D792,803 | S | 7/2017 | Abdourahim |
| D796,372 | S | 9/2017 | Gruosi |
| D797,599 | S | 9/2017 | Yatsugi-Kang |
| D800,012 | S | 10/2017 | Oliner-Katz |
| D807,774 | S | 1/2018 | Hardy |
| D808,851 | S | 1/2018 | Kwon |
| D809,419 | S | 2/2018 | Hardy |
| D809,960 | S | 2/2018 | Marchand |
| D809,961 | S | 2/2018 | Magallanes-Leal |
| D809,962 | S | 2/2018 | Le Bail |
| D810,612 | S | 2/2018 | Corey et al. |
| D811,928 | S | 3/2018 | Stern |
| D812,510 | S | 3/2018 | Levy |
| D813,080 | S | 3/2018 | Sallard |
| D813,708 | S | 3/2018 | Lane |
| D813,709 | S | 3/2018 | Dholakiya |
| D814,291 | S | 4/2018 | Taylor |
| D815,556 | S | 4/2018 | Stern |
| D816,538 | S | 5/2018 | Nickels |
| D818,867 | S | 5/2018 | Heller |
| D820,145 | S | 6/2018 | Galli |
| D822,531 | S | 7/2018 | Stern |
| D822,532 | S | 7/2018 | Stern |
| D824,276 | S | 7/2018 | Blootacker |
| D824,277 | S | 7/2018 | Sallard |
| D826,080 | S | 8/2018 | Gentile et al. |
| D834,988 | S | 12/2018 | Silvestri |
| D836,018 | S | 12/2018 | An |
| D842,753 | S | 3/2019 | Morin |
| D846,423 | S | 4/2019 | Buccellati |
| D847,683 | S | 5/2019 | Buccellati |
| D851,532 | S | 6/2019 | Yamada |
| D852,079 | S | 6/2019 | Sivriere |
| D878,958 | S | 3/2020 | Tashjian |
| 2005/0279135 | A1* | 12/2005 | Marcovitch ..... A44C 11/00 63/12 |
| 2008/0022720 | A1 | 1/2008 | Ciccone |
| 2010/0212356 | A1 | 8/2010 | Namiki |
| 2011/0083471 | A1 | 4/2011 | Chough |
| 2013/0186134 | A1 | 7/2013 | Goldstein |
| 2014/0150496 | A1 | 6/2014 | Briggs-Jenkins |
| 2017/0079388 | A1 | 3/2017 | Kita |
| 2018/0343990 | A1 | 12/2018 | Repossi |
| 2019/0174884 | A1* | 6/2019 | Todorova ..... A44C 7/007 |

OTHER PUBLICATIONS

Casasconil.info Chandelier, Glass Crystal Chandelier Drops, Jul. 28, 2018 (54 pages).

Crafty Blog Stalker, How to Make Crystal Drop Earrings, https://thecraftyblogstalker.com/diy-rhinestone-drop-earrings/, last updated Jun. 17, 2019 (12 pages).

Free People, 6.5mm Gold Tassel Eternity Single Earring https://www.freepeople.com/shop/65mm-gold-tassel-eternityingle-earring/. Retrieved by USPTO Examiner Aug. 31, 2019.

Maria Tash, 16mm Diamond In-Set Lotus Coronet Hoops Pair, http://www.mariatash.com/16mm-diamond-inet-lotcoronet-hoops-pair.html?metal=White%20Gold. Retrieved by USPTO Examiner Sep. 9, 2019.

Maria Tash, 6.5mm Diamond Eternity Ring and Two Cuffs, https://www.mariatash.com/jewelry/earlobe/diamond-1-4-tripie-eternity-ringnd-two-cuffs-earlobe.html?metal=White%20Gold. Retrieved by USPTO Examiner Sep. 9, 2019.

Maria Tash, 6.5mm Diamond Tassel Eternity Ring, https://www.mariatash.com/jewelry/earlobe/1-4-diamond-tassel-eternity-ring.html?metal=White%20Gold. Retrieved by USPTO Examiner Aug. 31, 2019.

Maria Tash, Diamond Delia and Marquise Dangle Chain Orbital, .https://www.mariatash.com/jewelry/earobe/diamond-delia-marquisend-rounds-chainnd-dangles-orbital.html?metal=Rose%20Gold. Retrieved by USPTO Examiner Aug. 17, 2019.

Maria Tash, Diamond Eternity Ring and Cuff, https://modesens.com/product/maria-tash-diamond-eternity-ringnd-cuff-18kt-rose-goldingle-earring-pink-5724852/. Retrieved by USPTO Examiner Sep. 9, 2019.

Maria Tash, Earrings, https://mariatash.com/jewelry/earlobe.html; downloaded from Internet Jun. 30, 2019 (35 pages).

Maria Tash, Invisible Diamond Lotus Close Garland Ear Climber, https://www.mariatash.com/jewelry/invisible-diamond-lotus-garland-ear-climber.html. Retrieved by Examiner Jul. 5, 2020 (2 pages).

Maria Tash, 14g 8mm Single Chain Septum Spinner, https://www.mariatash.com/14g-8mm-single-chain-septum-spinner.html#; downloaded from Internet Aug. 31, 2020 (1 page).

* cited by examiner

FIG. 38 - The Drape Piercing

The Drape Piercing can be done in the upper conch of the ear hidden by the inferior crus of the antihelix, or in the bowl of the helix. To execute the helix piercing, the upper helix tissue is lifted and the needle is placed underneath. This is referred to as the Tash Helix. To execute the conch piercing, the tissue of the inferior crus of the antihelix is lifted and the needle is placed underneath, in the upper conch. This is referred to as the Tash Hidden Rook

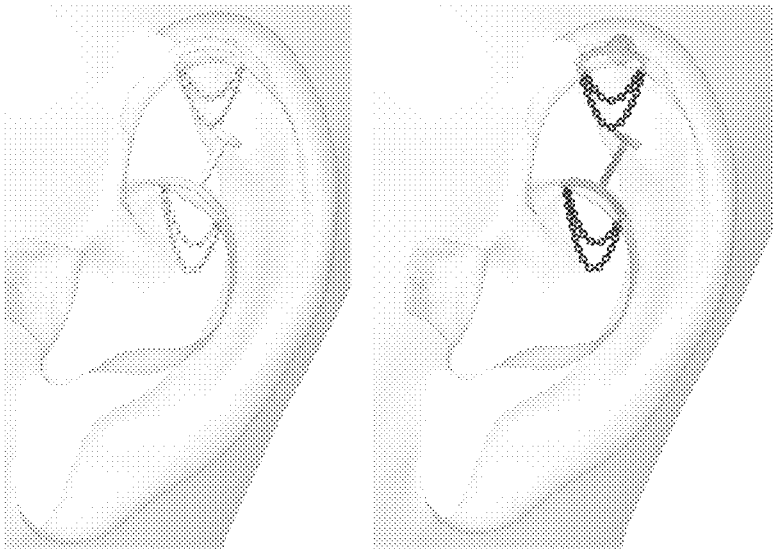

FIG. 39 - Drape piercing in the rook - "Tash Hidden Rook Piercing"
Procedure: The tissue of the inferior crus is lifted and the needle is pushed straight up for vertical piercing angle or straight back for horizontal piercing angle
Example of vertical piercing angle needle placement
A - 3D model
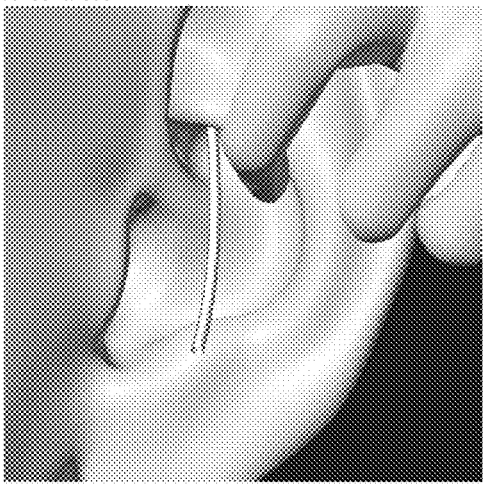
B- Human model
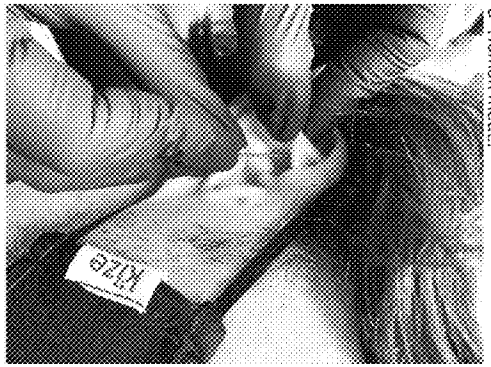

FIG. 40
Horizontal piercing angle needle placement
A - 3D Model
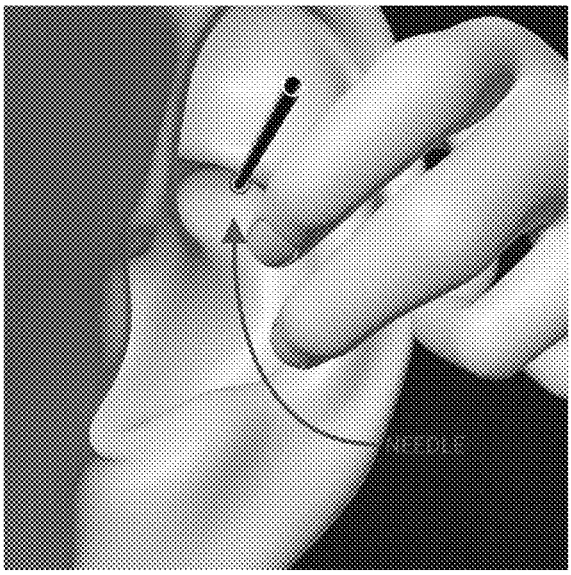
H- human model
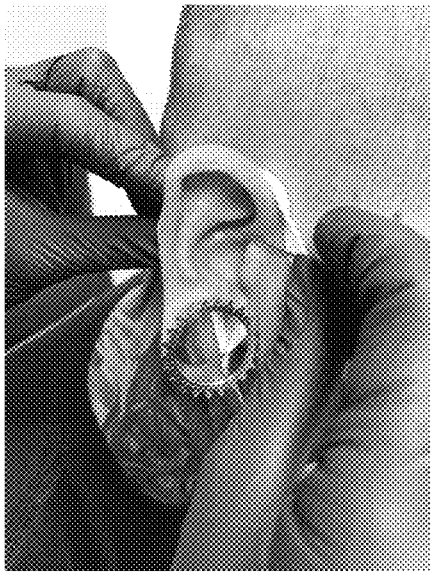

FIG. 41
The Tash Hidden Rook Piercing end result
A - 3D Model
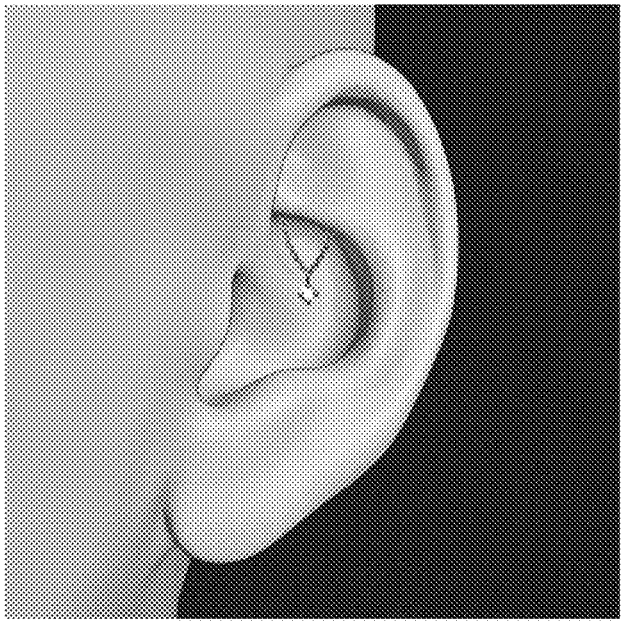
B - human Model
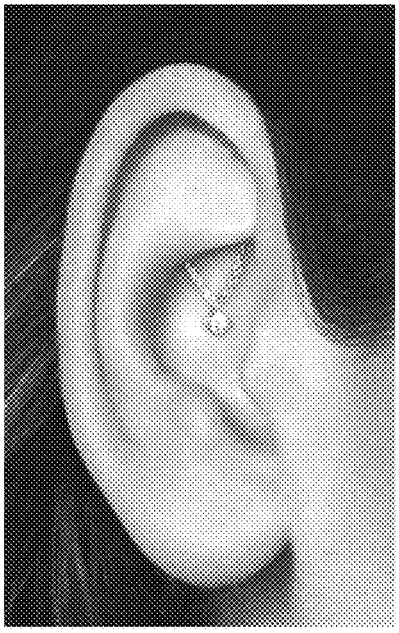

FIG. 42 - Drape piercing in the helix - "Tash Helix Piercing"
Procedure: The upper flap of the helix tissue is lifted and the needle is placed at a high point and pushed straight back for horizontal piercing angle or straight up for vertical piercing angle.
Tash Helix horizontal piercing angle needle placement
A - 3D Model
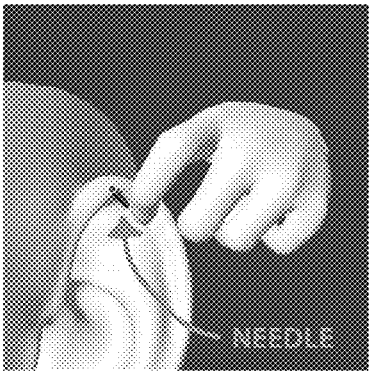
B- human Model
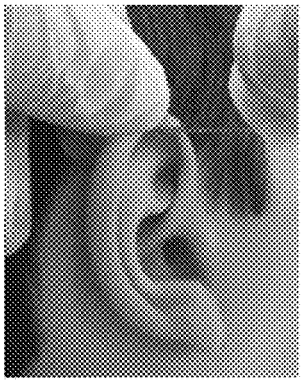

FIG. 43 - The Tash Helix Piercing end result
A - 3D Model
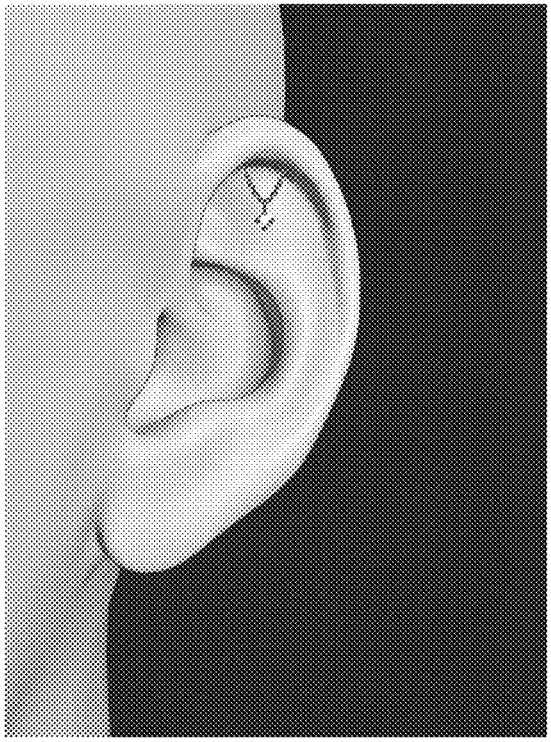
B - Human Model
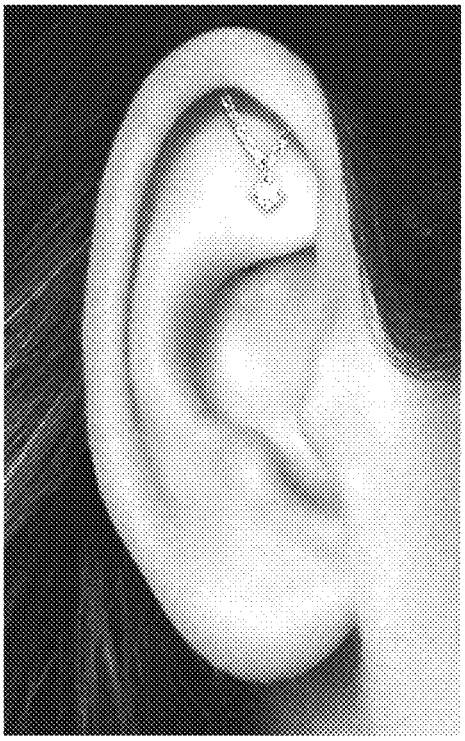

FIG. 44 - Drape Jewelry
A - Horizontal piercing
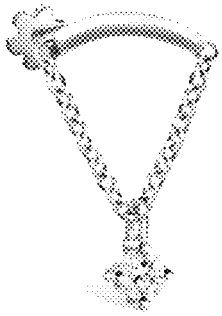
B - Vertical piercing
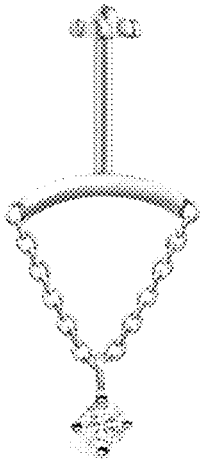

FIG. 45
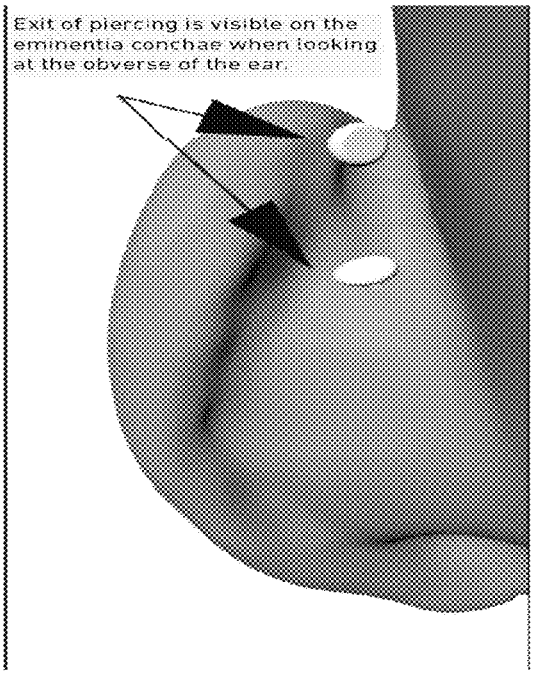
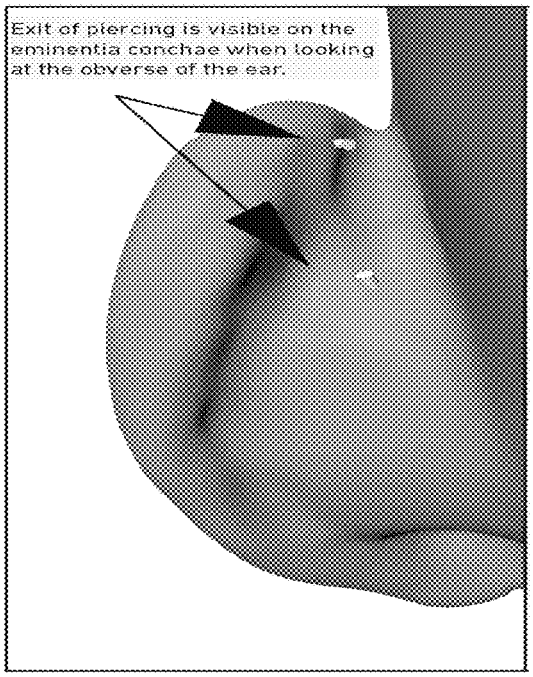

PIERCING TECHNIQUES, EARRINGS THEREFOR, AND METHODS OF MANUFACTURE AND USE THEREOF

CROSS-REFERENCE TO RELATED PATENT APPLICATIONS

This patent application is a continuation-in-part of U.S. Design patent application 29/725,811, filed on 27 Feb. 2020, which is herein incorporated by reference for all purposes.

This patent application is a continuation-in-part of U.S. Design patent application 29/749,236, filed on 3 Sep. 2020, which is herein incorporated by reference for all purposes.

BACKGROUND

An earring is a piece of jewelry that can be attached to an ear of a wearer. When the wearer wears the earring, a bystander can usually readily comprehend how the earring is attached to the ear of the wearer when the bystander views the ear of the wearer frontally straight-on.

SUMMARY

Generally, this disclosure enables various piercing techniques, earrings therefor, and methods of manufacture and use thereof. In particular, these technologies can preclude a bystander from readily comprehending how an earring is attached to an ear of a wearer when the bystander views the ear of the wearer frontally straight-on. This preclusion occurs by providing a floating effect for the earring based on where the ear is pierced and how the earring is structured. For example, the ear of the wearer can be pierced such that a hole in a helix of the ear or a superior concha of the ear is formed, where the hole is respectively anatomically covered by a superior helix of the ear or an inferior antihelix crus of the ear such that the hole is respectively anatomically hidden by the superior helix of the ear or the inferior antihelix crus of the ear when the ear is viewed frontally straight-on. Then, a post of an earring can be inserted into the hole such that the earring is coupled to the ear via the post and the post is respectively anatomically hidden by the superior helix of the ear or the inferior antihelix crus of the ear when the ear is viewed frontally straight-on. Therefore, if the post extends from a member (e.g., a setting for a stone, a rectilinear member, an arcuate member) that extends over the hole, then the floating effect can be provided based on the member being respectively anatomically hidden by the superior helix of the ear or the inferior antihelix crus of the ear when the ear is viewed frontally straight-on. If the member is coupled to a line (e.g., a chain), then the line can be not respectfully anatomically hidden by the superior helix of the ear or the inferior antihelix crus of the ear when the ear is viewed frontally straight-on. If the member is coupled to a stone or a setting for a stone, then the stone or the setting for the stone can be not respectfully anatomically hidden by the superior helix of the ear or the inferior antihelix crus of the ear when the ear is viewed frontally straight-on. As such, the line, the stone, or the setting for the stone can appear to be suspended from the ear, thereby enabling the floating effect for the earring.

In an embodiment, a method comprises: causing an ear to be pierced such that a hole in a helix of the ear or a superior concha of the ear is formed, wherein the hole is respectively anatomically covered by a superior helix of the ear or an inferior antihelix crus of the ear such that the hole is respectively anatomically hidden by the superior helix of the ear or the inferior antihelix crus of the ear when the ear is viewed frontally straight-on; and causing a post of an earring to be inserted into the hole such that the earring is coupled to the ear via the post and the post is respectively anatomically hidden by the superior helix of the ear or the inferior antihelix crus of the ear when the ear is viewed frontally straight-on.

In an embodiment, a device comprises: an earring having a securing portion consisting of a backing, a post, and a member, wherein the post has a first longitudinal end portion and a second longitudinal end portion, wherein the backing is coupled to or extends over the first longitudinal end portion, wherein the member extends from the second longitudinal end portion.

DESCRIPTION OF DRAWINGS

FIGS. 38-43 shows a plurality of embodiments of piercing a helix and piercing a superior concha according to this disclosure.

FIG. 44 shows a plurality of embodiments of a plurality of earrings for coupling to an ear when the ear is pierced at a helix or a superior concha according to this disclosure.

FIG. 45 shows a plurality of embodiments of a post exiting an obverse side of an ear according to this disclosure.

DETAILED DESCRIPTION

Figure 1:
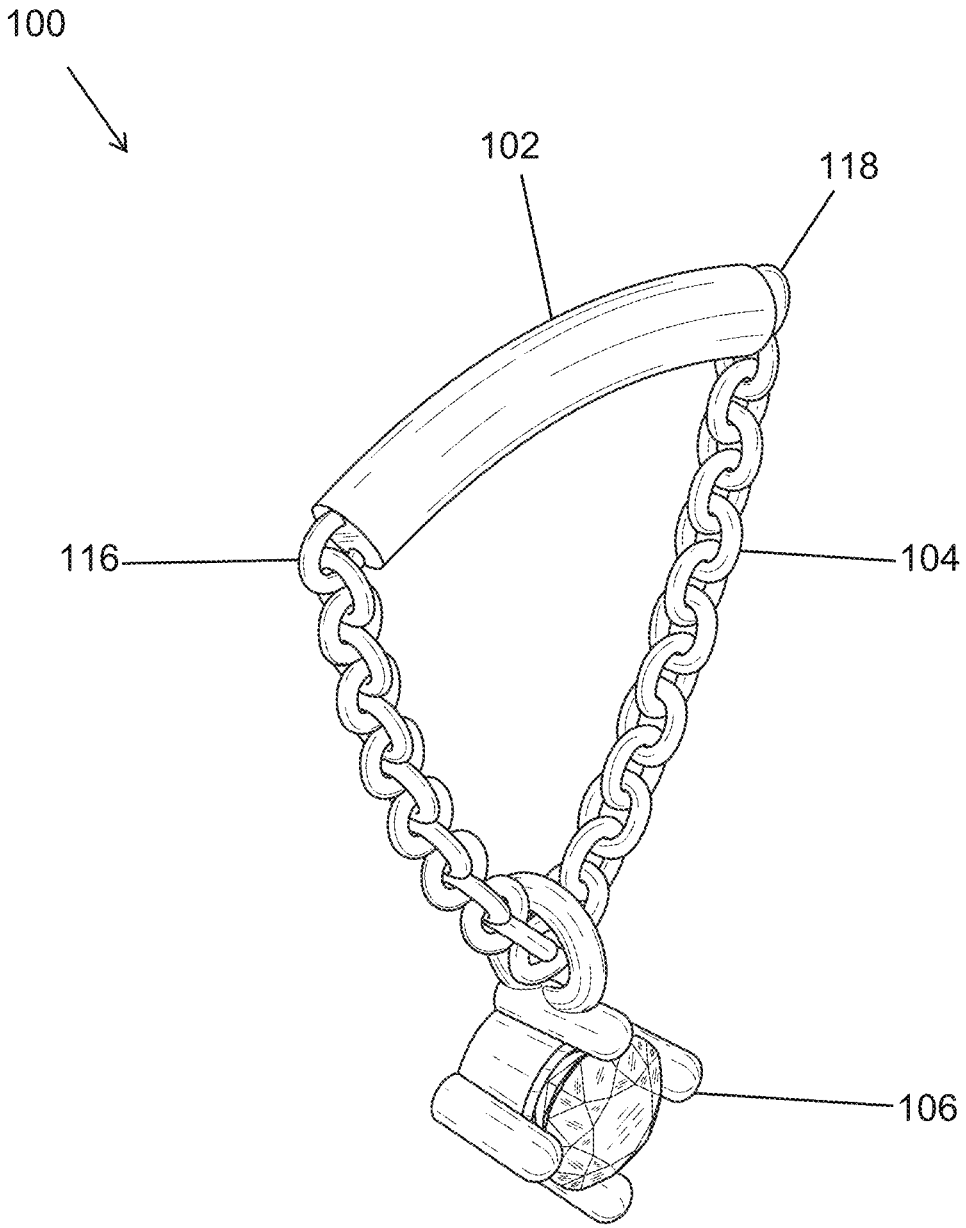
FIGS. 1-35 show a plurality of embodiments of an earring according to this disclosure.
Figure 2:
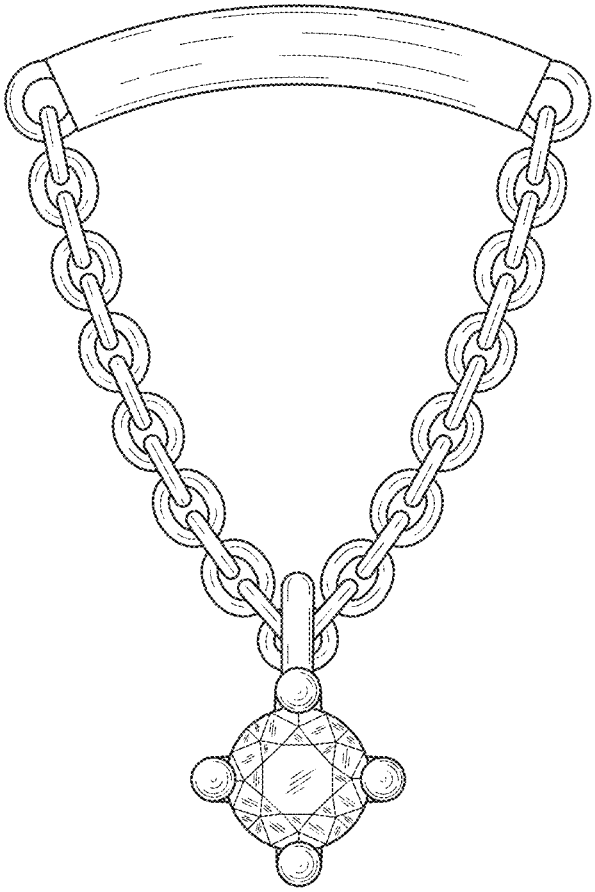
Figure 3:
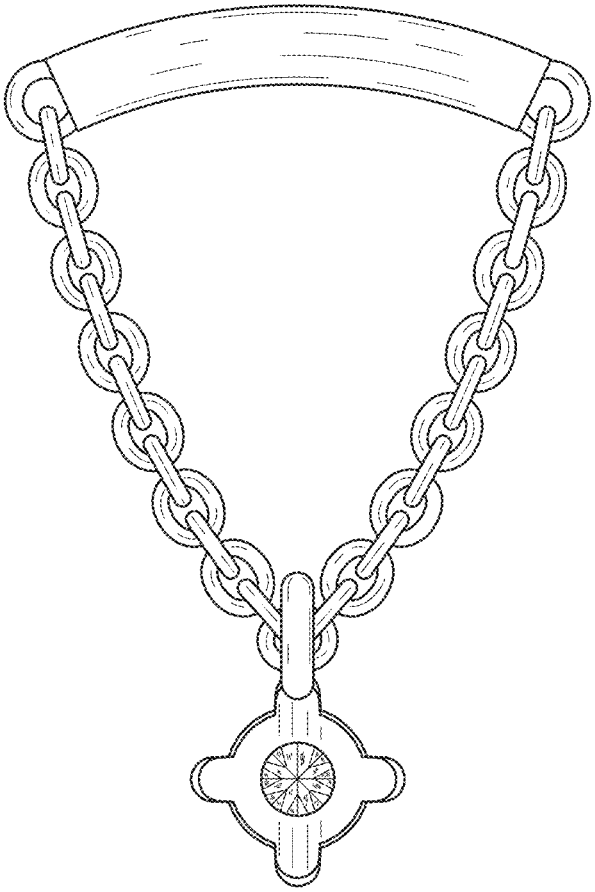
Figure 4:
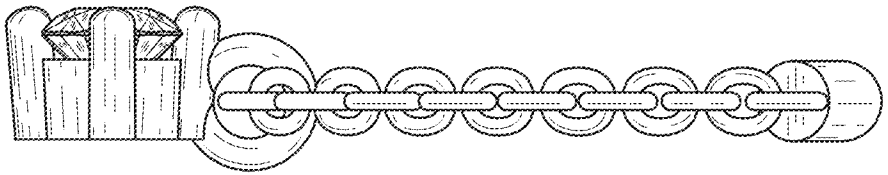
Figure 5:
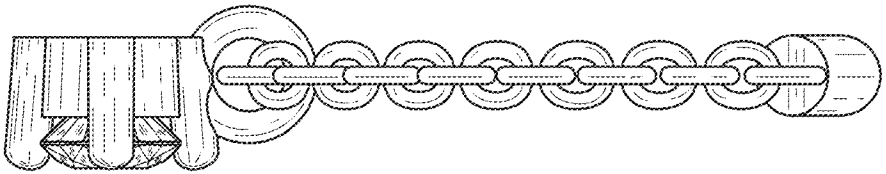
Figure 6:
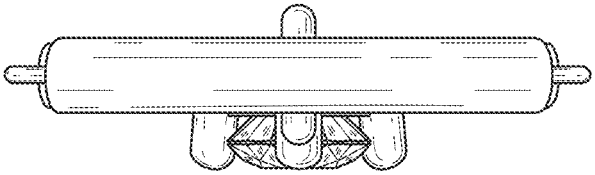
Figure 7:
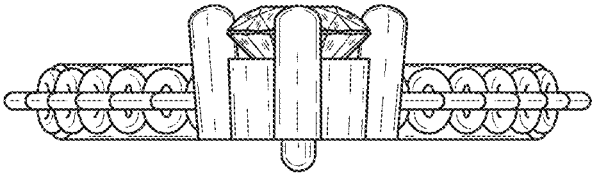

Generally, this disclosure enables various piercing techniques, earrings therefor, and methods of manufacture and use thereof. In particular, these technologies can preclude a bystander from readily comprehending how an earring is attached to an ear of a wearer when the bystander views the ear of the wearer frontally straight-on. This preclusion occurs by providing a floating effect for the earring based on where the ear is pierced and how the earring is structured. For example, the ear of the wearer can be pierced such that a hole in a helix of the ear or a superior concha of the ear is formed, where the hole is respectively anatomically covered by a superior helix of the ear or an inferior antihelix crus of the ear such that the hole is respectively anatomically hidden by the superior helix of the ear or the inferior antihelix crus of the ear when the ear is viewed frontally straight-on. Then, a post of an earring can be inserted into the hole such that the earring is coupled to the ear via the post and the post is respectively anatomically hidden by the superior helix of the ear or the inferior antihelix crus of the ear when the ear is viewed frontally straight-on. Therefore, if the post extends from a member (e.g., a setting for a stone, a rectilinear member, an arcuate member) that extends over the hole, then the floating effect can be provided based on the member being respectively anatomically hidden by the superior helix of the ear or the inferior antihelix crus of the ear when the ear is viewed frontally straight-on. If the member is coupled to a line (e.g., a chain), then the line can be not respectfully anatomically hidden by the superior helix of the ear or the inferior antihelix crus of the ear when the ear is viewed frontally straight-on. If the member is coupled to a stone or a setting for a stone, then the stone or the setting for the stone can be not respectfully anatomically hidden by the superior helix of the ear or the inferior antihelix crus of the ear when the ear is viewed frontally straight-on. As such, the line, the stone, or the setting for the stone can appear to be suspended from the ear, thereby enabling the floating effect for the earring. However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

FIGS. 1-35 show a plurality of embodiments for a plurality of earrings according to this disclosure. In particular, an earring 100 has an arcuate member 102, a line 104, a dangling element 106, a post 108, and a backing 110. The backing 110 has a tubular member 112 and an end member 114. The arcuate member 102 has a first longitudinal end portion 116 and a second longitudinal end portion 118.

The arcuate member 102 longitudinally extends as an arc, which can include a plurality of consecutive arcs, thereby forming a sinusoidal wave. The arcuate member 102 includes metal (e.g., gold, silver, titanium, copper, brass, nickel, iron, nitinol), but can include other suitable materials (e.g., plastic, rubber, silicon). The arcuate member 102 is rigid (e.g., cannot be bent or flexed manually by hand), but can be flexible (e.g., can be manually bent or flexed by hand). The arcuate member 102 has a tubular portion extending between the first longitudinal end portion 116 and the second longitudinal end portion 118. For example, the tubular portion spans between the first longitudinal end portion 116 and the second longitudinal end portion 118. The tubular portion can be internally solid or internally hollow. However, note that the arcuate member 102 can have a flat portion (e.g., single side, dual-sided, multi-sided) extending between the first longitudinal end portion 116 and the second longitudinal end portion 118. The flat portion can span between the first longitudinal end portion 116 and the second longitudinal end portion 118. The arcuate member 102 is cross-sectionally circular, but can be cross-sectionally oval, square, rectangular, triangular, pentagonal, octagonal, D-shaped, U-shaped, V-shaped, J-shaped, or others. The arcuate member 102 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering). Note that this disclosure is not limited to the arcuate member 102. For example, the member 102 can also be non-arcuate (e.g., a rectilinear member 102, a zigzag member 102, a setting 102 for a stone).

Each of the first longitudinal end portion 116 and the second longitudinal end portion 118 is a U-shape secured to its respective longitudinal end portion. Each of the first longitudinal end portion 116 and the second longitudinal end portion 118 includes a metal (e.g., gold, silver, titanium, copper, brass, nickel, iron, nitinol), but can include other suitable materials (e.g., plastic, rubber, silicon), whether identical or non-identical to each other. Each of the first longitudinal end portion 116 and the second longitudinal end portion 118 is rigid (e.g., cannot be bent or flexed manually by hand), but can be flexible (e.g., can be bent or flexed manually by hand). However, note that this configuration can vary and the first longitudinal end portion 116 or the second longitudinal end portion 118 can be a D-shape, an O-shape, an S-shape, a J-shape, a B-shape, or another suitable shape. Also, note that the first longitudinal end portion 116 or the second longitudinal end portion 118 can be embedded into or be integral with the arcuate member 102 instead of projecting out of the arcuate member 102. Each of the first longitudinal end portion 116 or the second longitudinal end portion 118 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering). Each of the first longitudinal end portion 116 or the second longitudinal end portion 118 is monolithic with the arcuate member 102 (e.g., (e.g., additively manufactured, subtractively manufactured, cast, injection molded), but can also be an assembly with the arcuate member 102 (e.g., fastening, mating, interlocking, hook-and-looping, magnetizing, adhering).

The line 104 extends from the arcuate member 102. The line 104 is embodied as a chain (e.g., identical links or non-identical links), but can also be embodied as a string, a cable, a wire, a tube, or any other suitable continuous material, whether rigid (e.g., cannot be bent or flexed manually by hand) or flexible (e.g., can be bent or flexed manually by hand). The line 104 is suspended from the first longitudinal end portion 116 and the second longitudinal end portion 118 such that the line 104 parabolically extends from the arcuate member 102. However, note that this configuration can vary. For example, the line 104 can extend not from the first longitudinal end portion 116 or the second longitudinal end portion 118, but from at least one point between the first longitudinal end portion 116 and the second longitudinal end portion 118. For example, the line 104 can extend not from the first longitudinal end portion 116 and the second longitudinal end portion 118, but between at least two points between the first longitudinal end portion 116 and the second longitudinal end portion 118. For example, the line 104 can be not non-parabolically extending from the arcuate member 102 (e.g., when the line 104 is attached to the arcuate member 104 at only at point). The line 104 is an assembly of pieces secured to each other (e.g., fastening, mating, interlocking, hook-and-looping, magnetizing, adhering), but can be a single monolithic piece (e.g., additively manufactured, subtractively manufactured, cast, injection molded). The line 104 is assembled (e.g., fastening, mating, interlocking, hook-and-looping, magnetizing, adhering) with the first longitudinal end portion 116 or the second longitudinal end portion 118, but can be monolithic with the first longitudinal end portion 116 or the second longitudinal end portion 118 (e.g., additively manufactured, subtractively manufactured, cast, injection molded).

The dangling element 106 is a setting (e.g., a frame, a platform, a chassis) holding a stone (e.g., a precious stone, a natural precious stone, an artificial precious stone, a diamond, a ruby, a sapphire). The dangling element 106 includes a metal (e.g., gold, silver, titanium, copper, brass, nickel, iron, nitinol), but can include other suitable materials (e.g., plastic, rubber, silicon), whether identical or non-identical to each other. The dangling element 106 is rigid (e.g., cannot be bent or flexed manually by hand), but can be flexible (e.g., can be bent or flexed manually by hand). The dangling element 106 has a ring extending from the setting. The dangling element 106 is suspended from the line 104 via the ring based on the line 104 extending through the ring. However, note that other objects (e.g., a line) can be suspended from the line 104, whether additionally or alternatively. The dangling element 106 is an assembly of pieces secured to each other (e.g., fastening, mating, interlocking, hook-and-looping, magnetizing, adhering), but can be a single monolithic piece (e.g., additively manufactured, subtractively manufactured, cast, injection molded). The dangling element 106 is assembled (e.g., fastening, mating, interlocking, hook-and-looping, magnetizing, adhering) with the line 104, but can be monolithic with the line 104 (e.g., additively manufactured, subtractively manufactured, cast, injection molded).

The arcuate member 102 has a post 108 extending therefrom. The post 108 is rectilinear, but can be arcuate, sinusoidal, or other suitable longitudinal extensions. The post 108 has a body portion (wider) and a shoulder portion (narrower), where the shoulder portion is configured for engagement (e.g., fastening, mating, interlocking, magnetizing, adhering) with the tubular member 106, as disclosed herein. The body portion extends through the ear of the wearer when the earring is worn, as disclosed herein. The post 108 includes a metal (e.g., gold, silver, titanium, copper, brass, nickel, iron, nitinol), but can include other suitable materials (e.g., plastic, rubber, silicon), whether identical or non-identical to each other. The post 108 is rigid (e.g., cannot be bent or flexed manually by hand), but can be flexible (e.g., can be bent or flexed manually by hand). The post 108 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering). The post 108 is monolithic with the arcuate member 102 (e.g., additively manufactured, subtractively manufactured, cast, injection molded), but can also be assembled with the arcuate member 102 (e.g., fastening, mating, interlocking, hook-and-looping, magnetizing, adhering).

Figure 8:
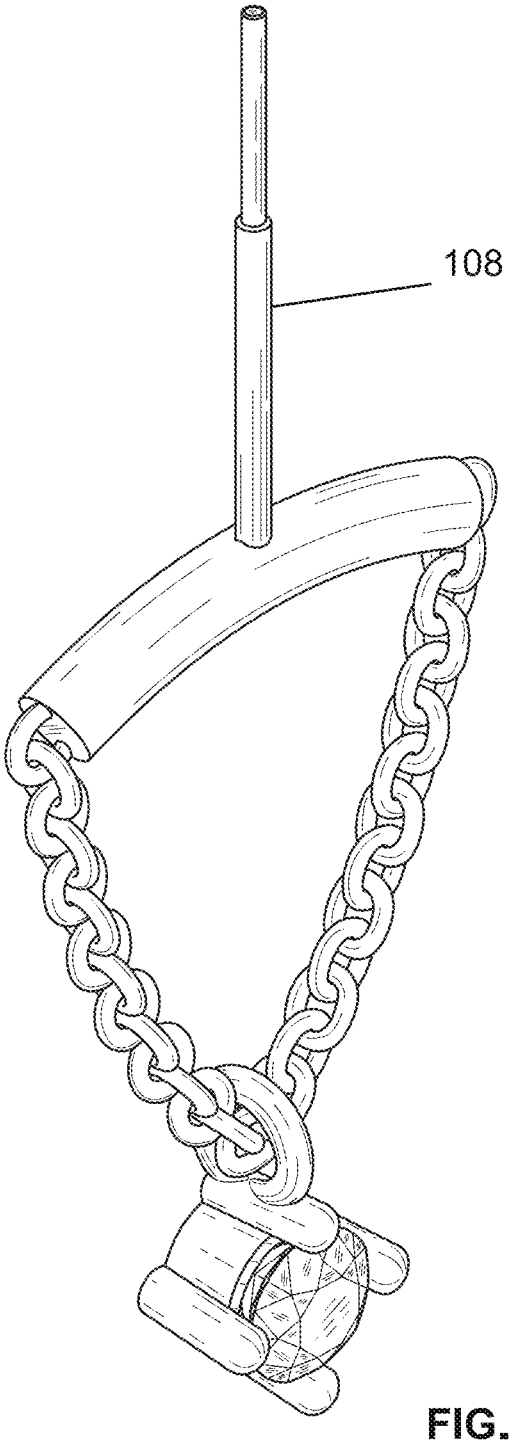
Figure 9:
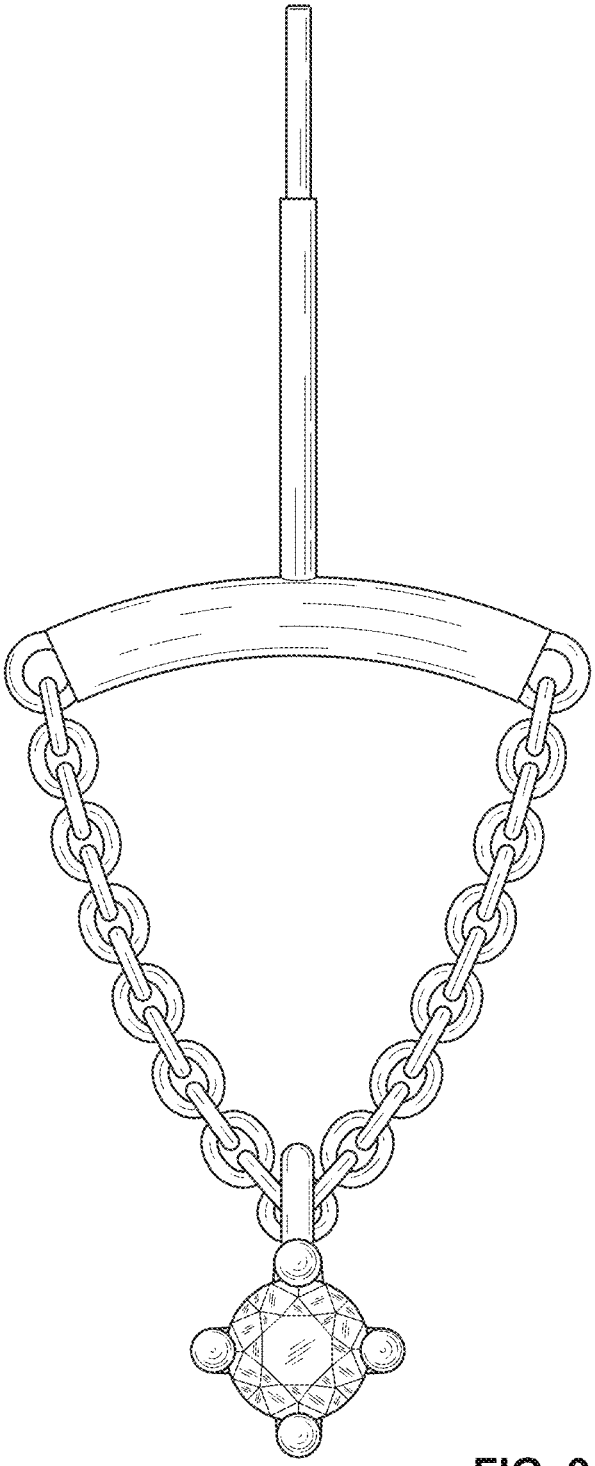
Figure 10:
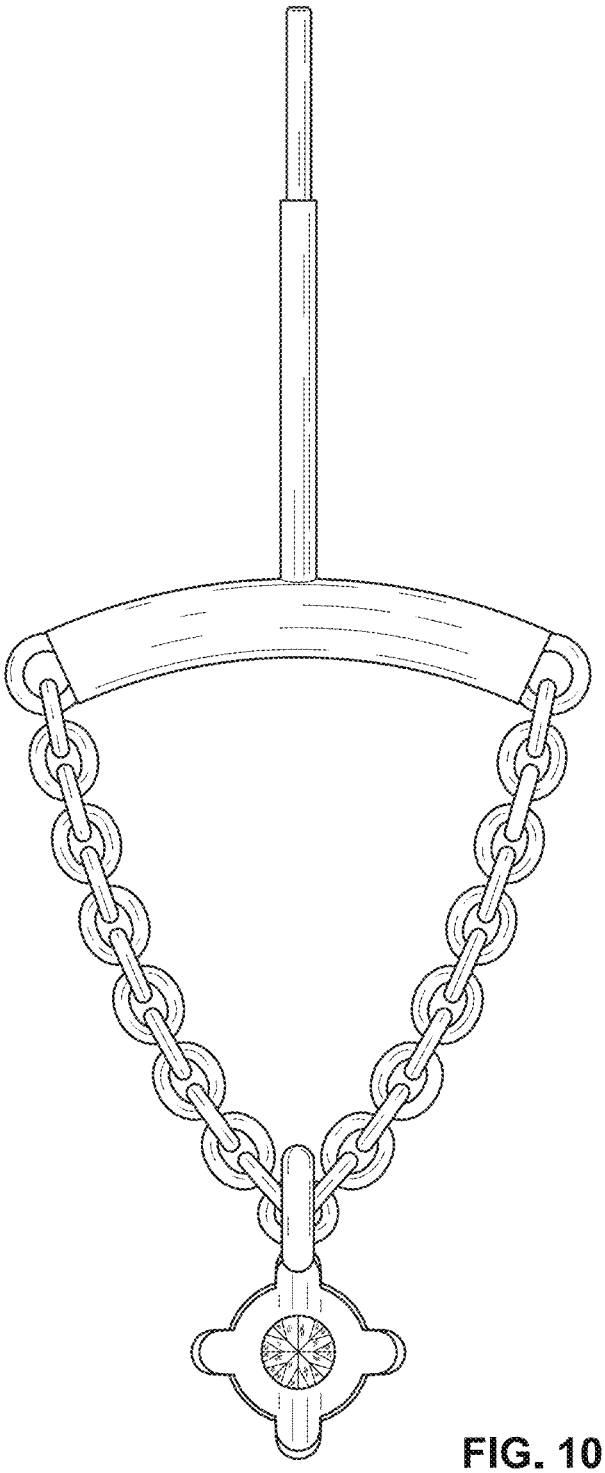
Figure 11:
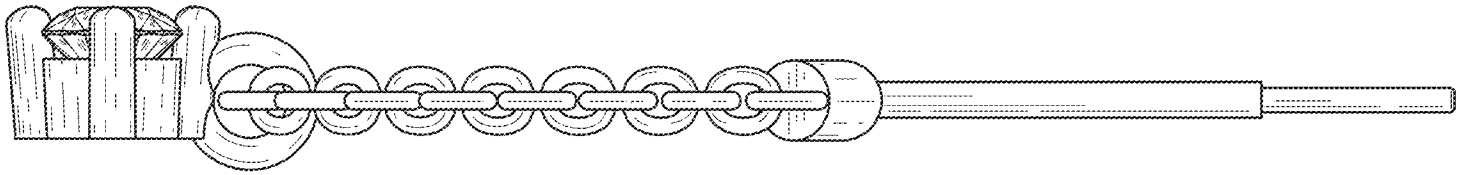
Figure 12:
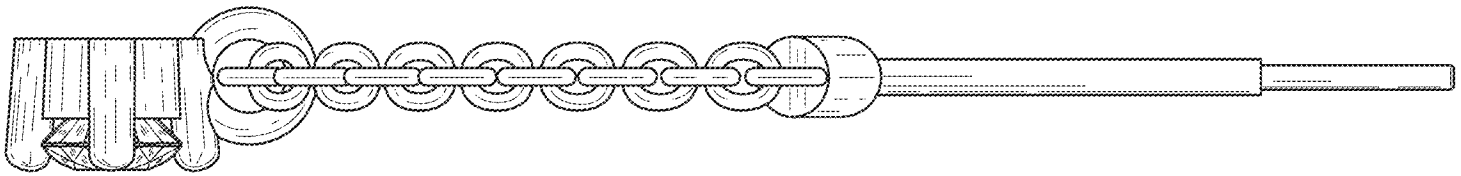
Figure 13:
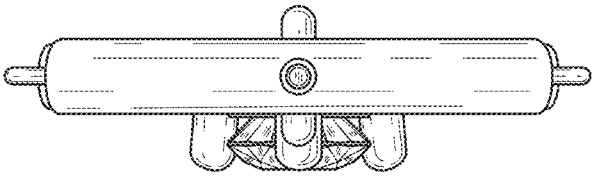
Figure 14:
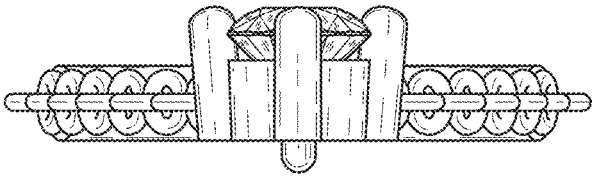
Figure 15:
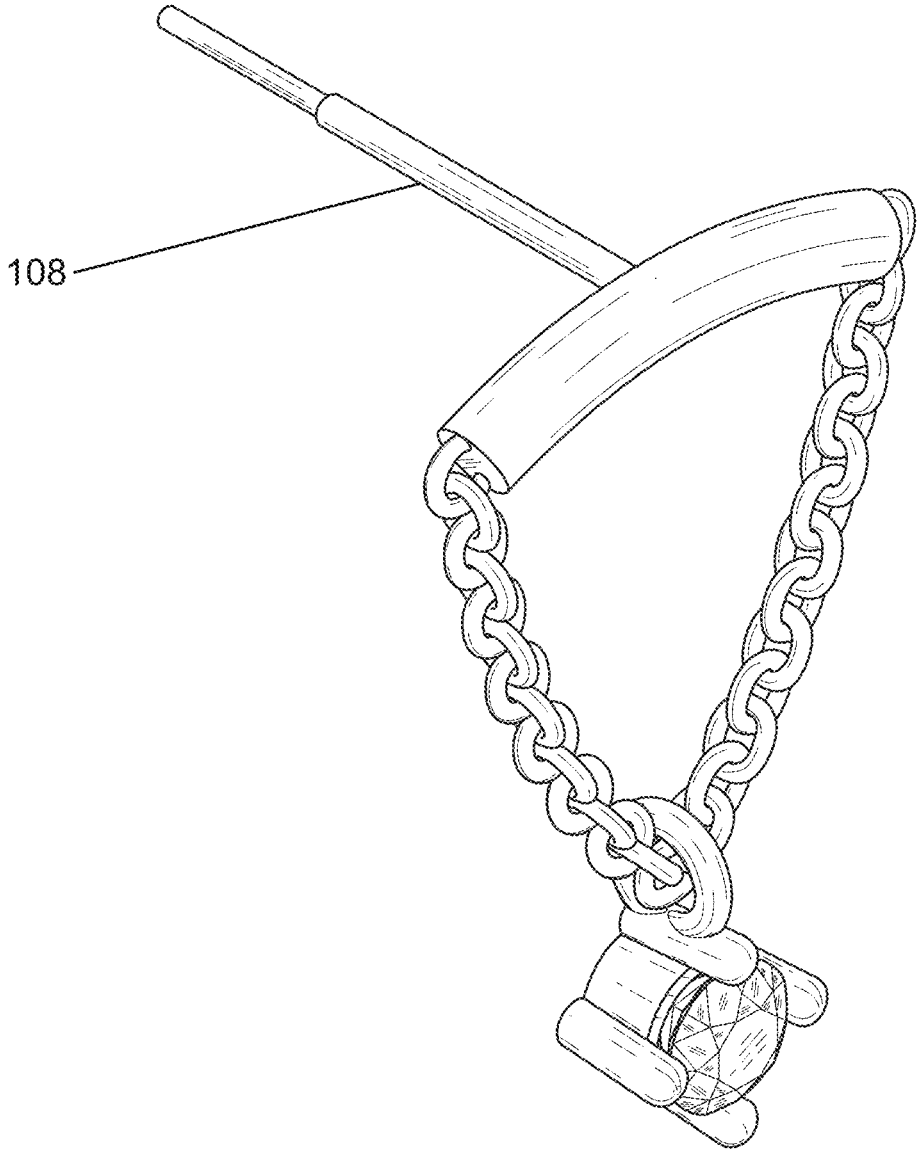
Figure 16:
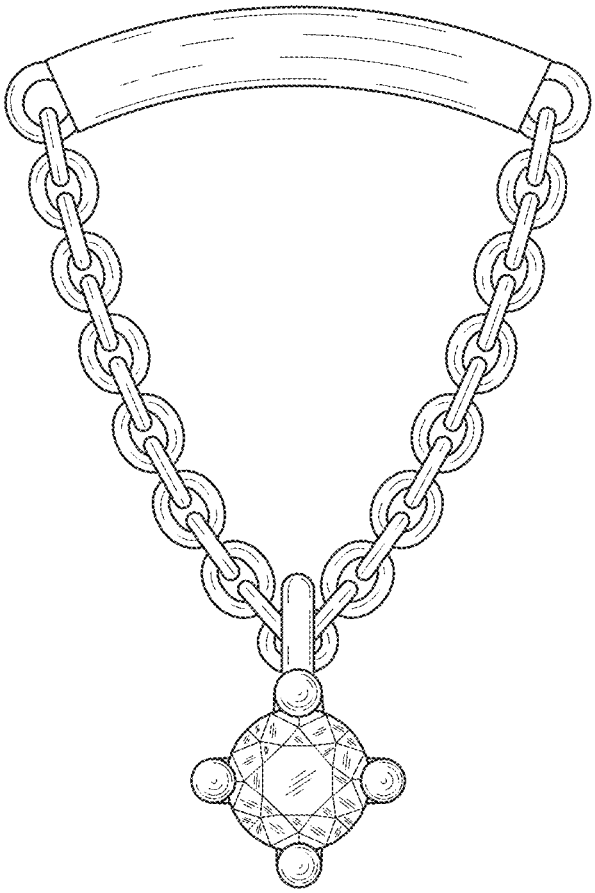
Figure 17:
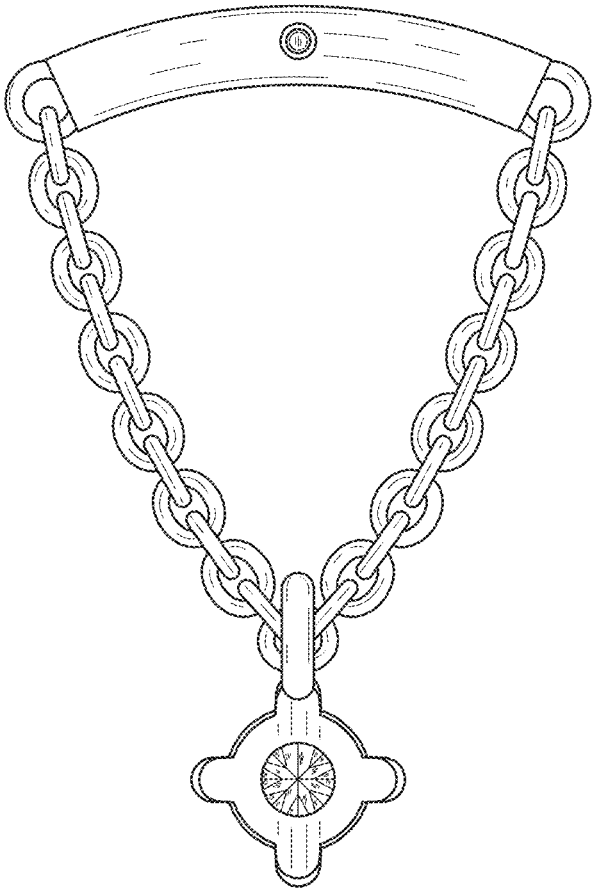
Figure 18:
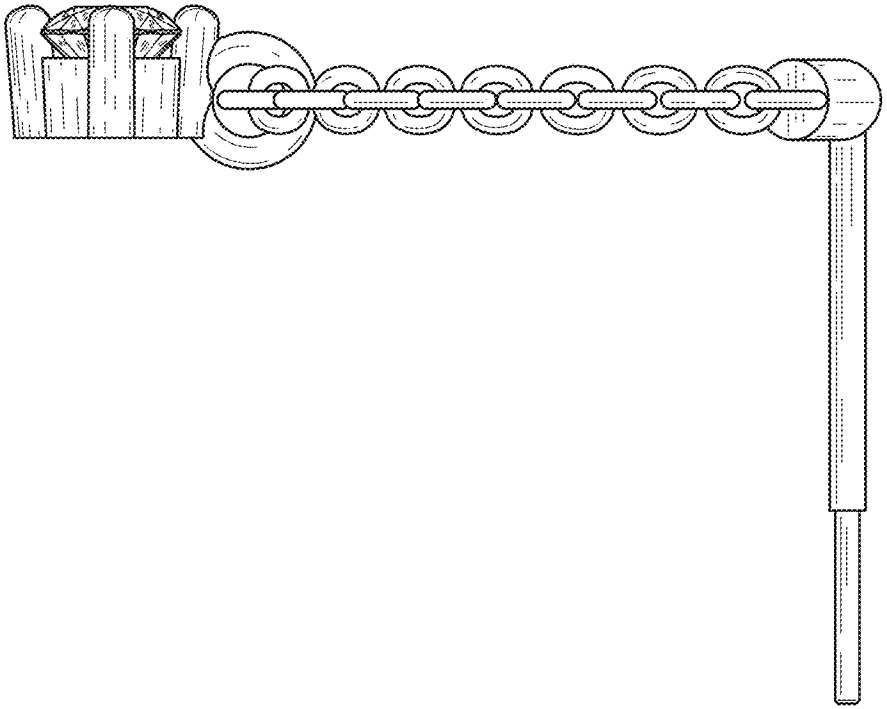
Figure 19:
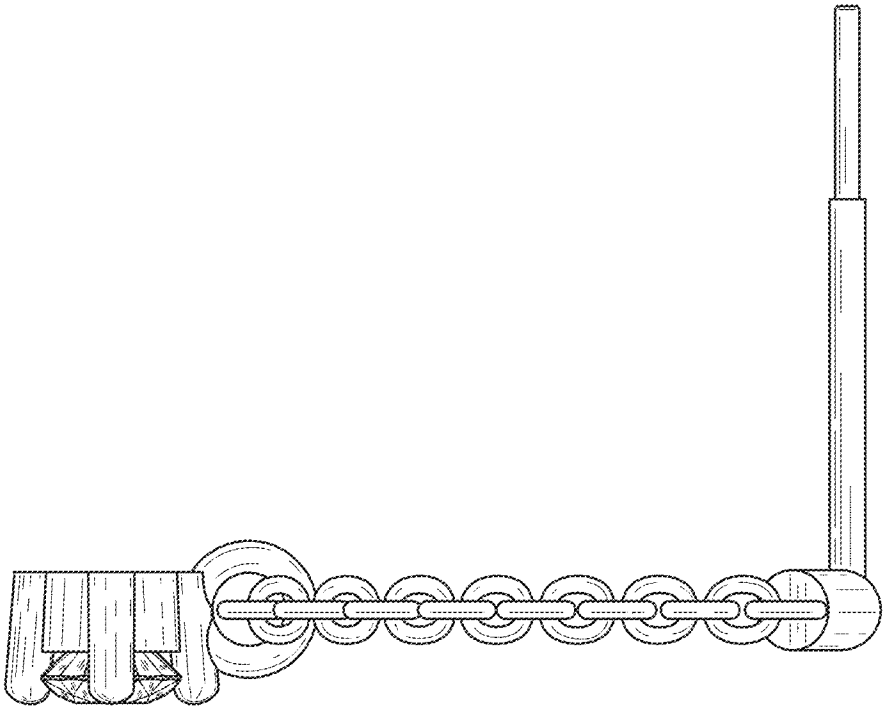
Figure 20:
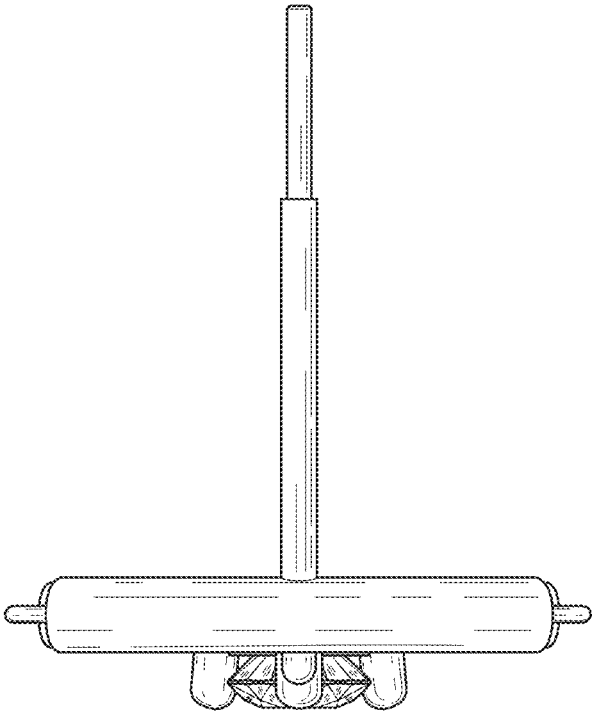
Figure 21:
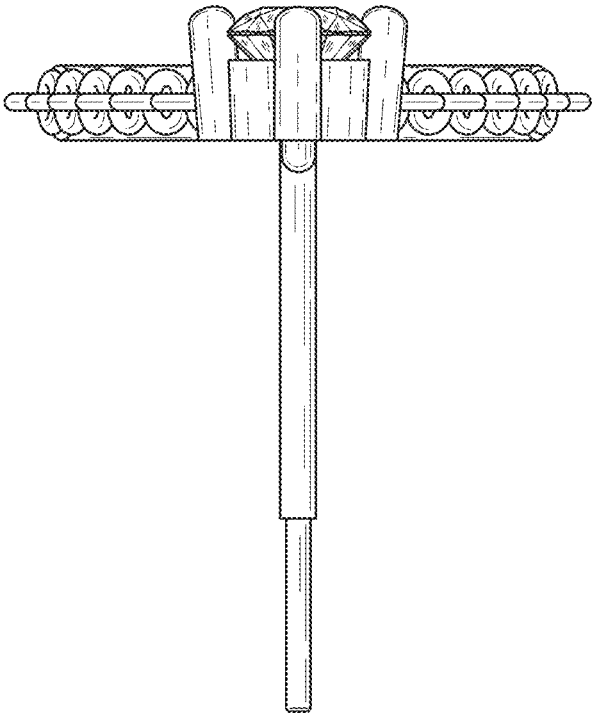
Figure 22:
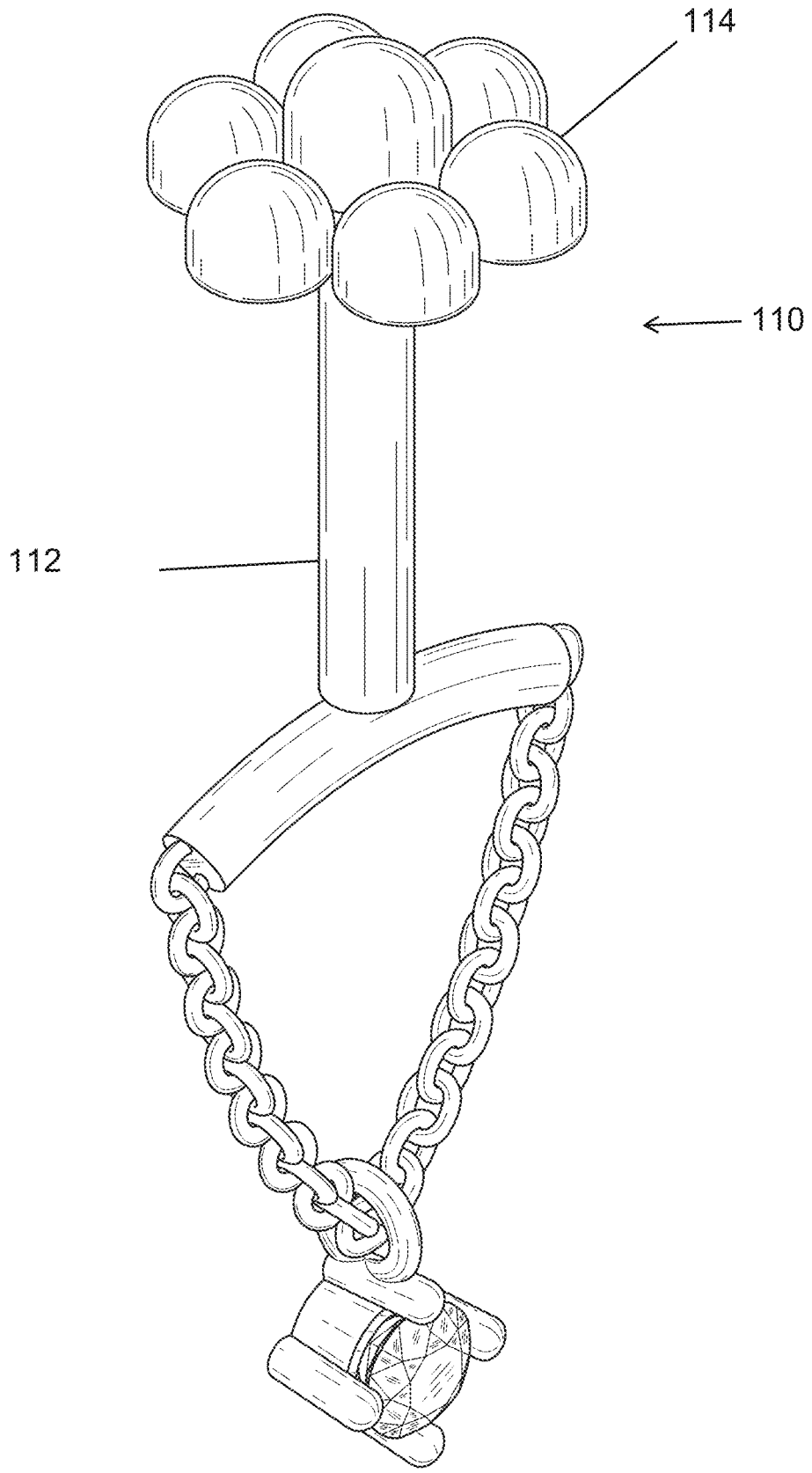
Figure 23:
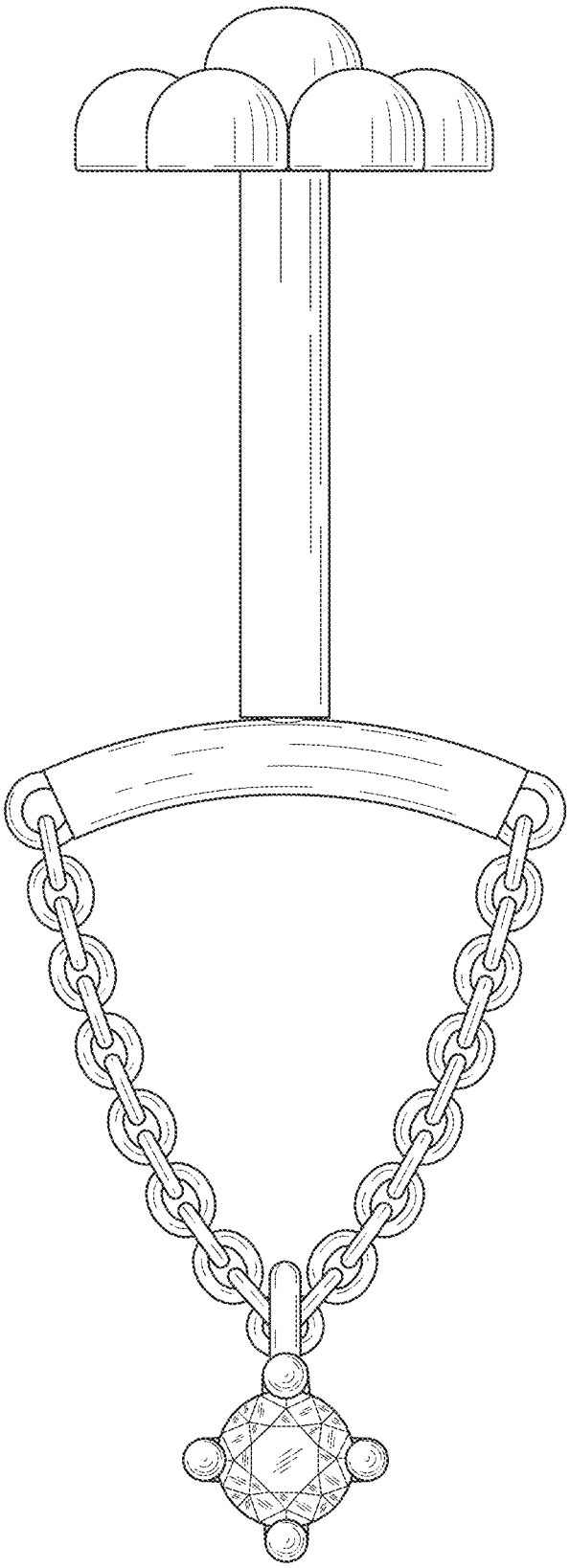
Figure 24:
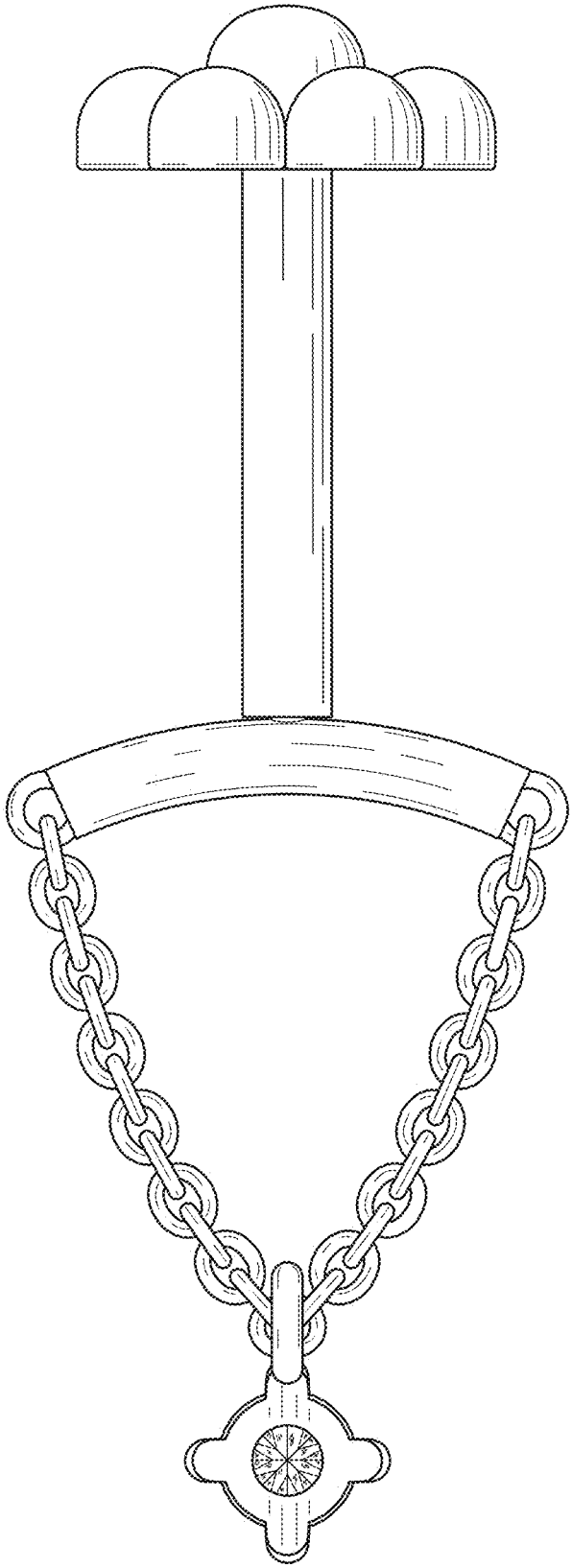
Figure 25:
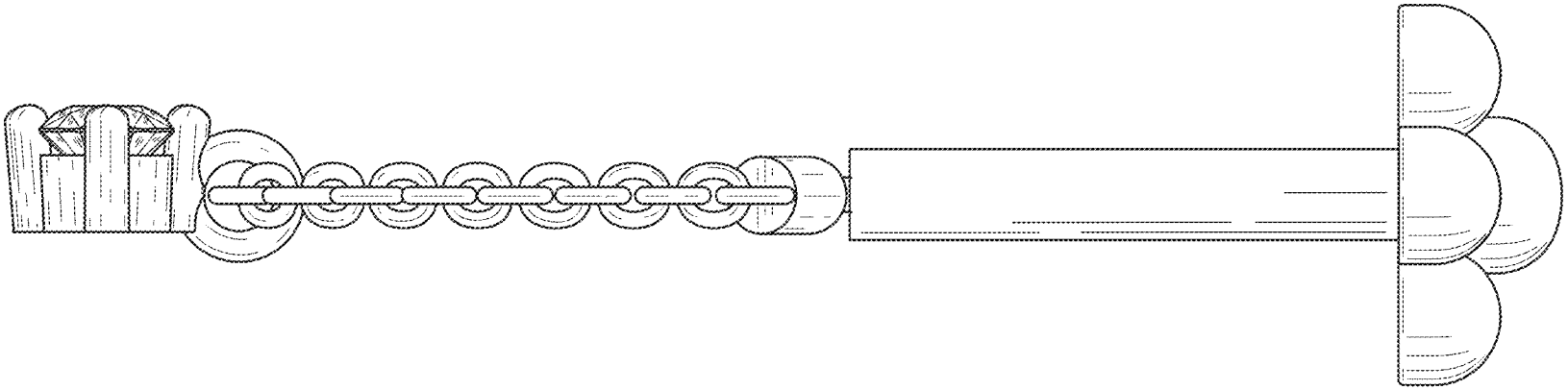
Figure 26:
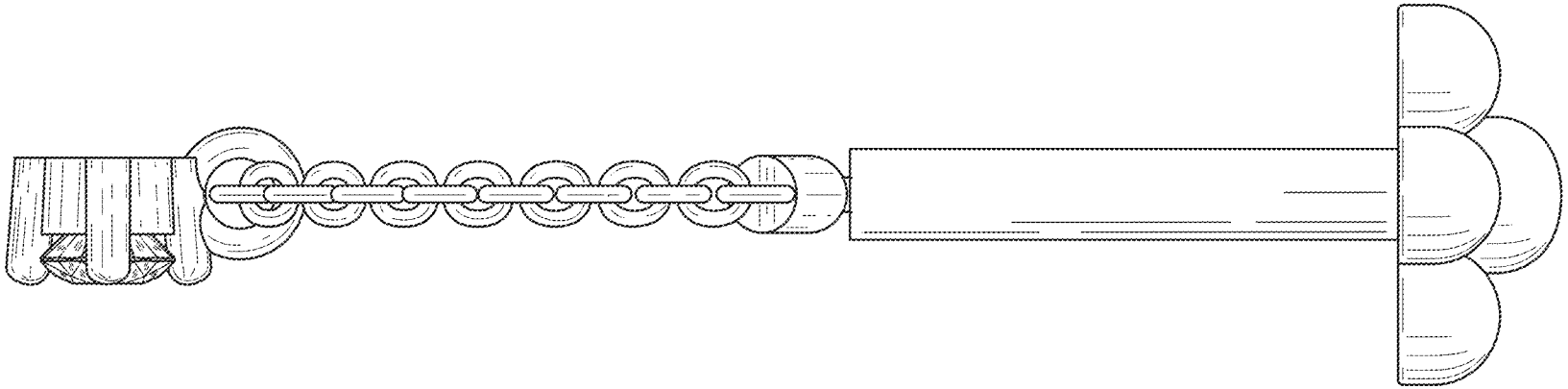
Figure 27:
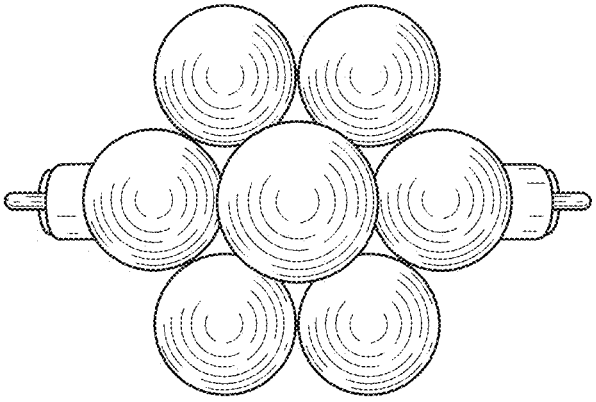
Figure 28:
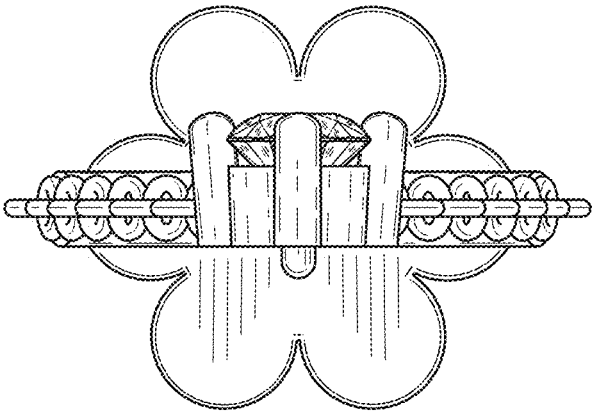
Figure 29:
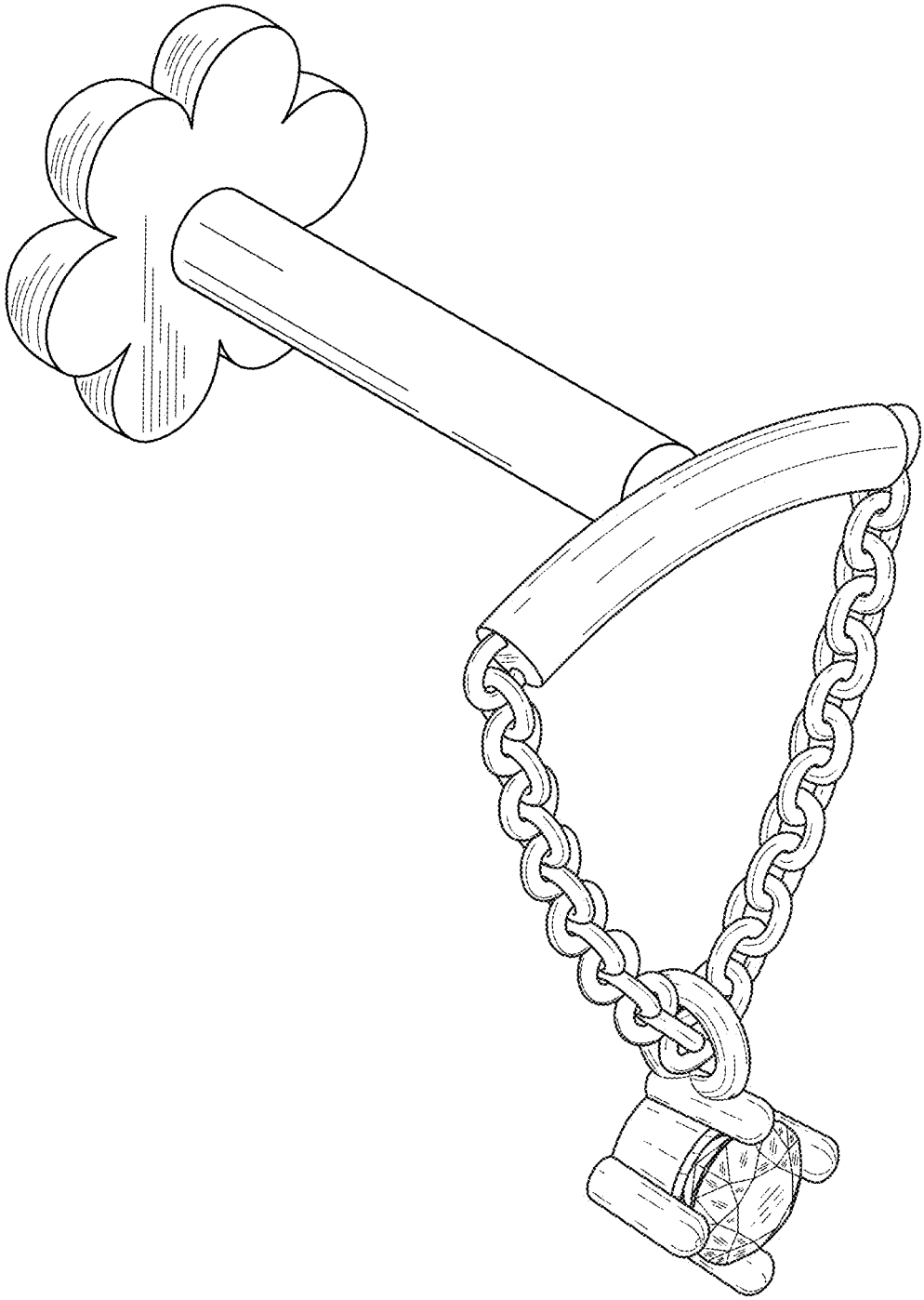
Figure 30:
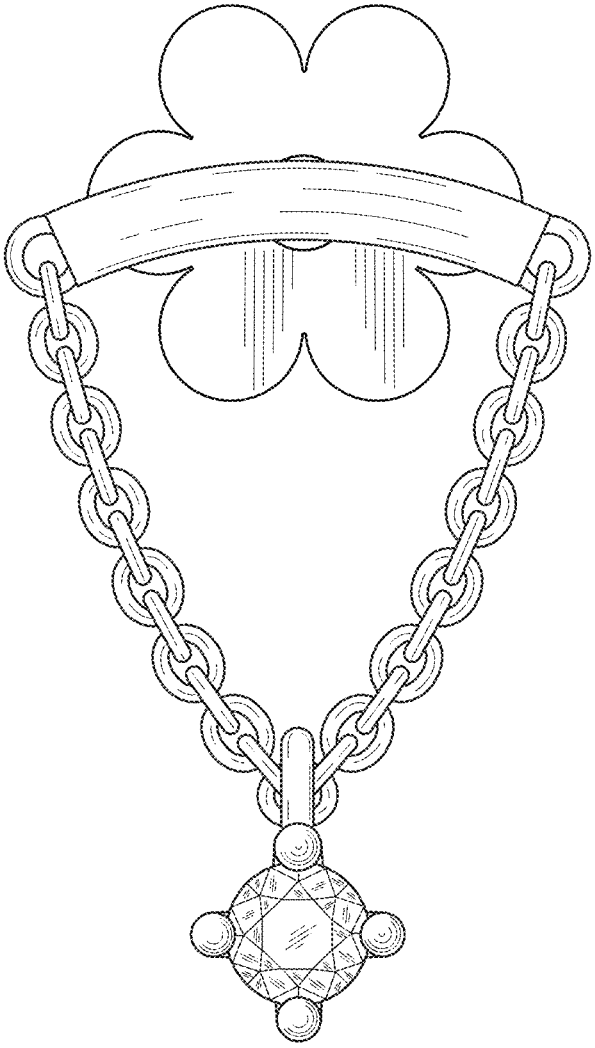
Figure 31:
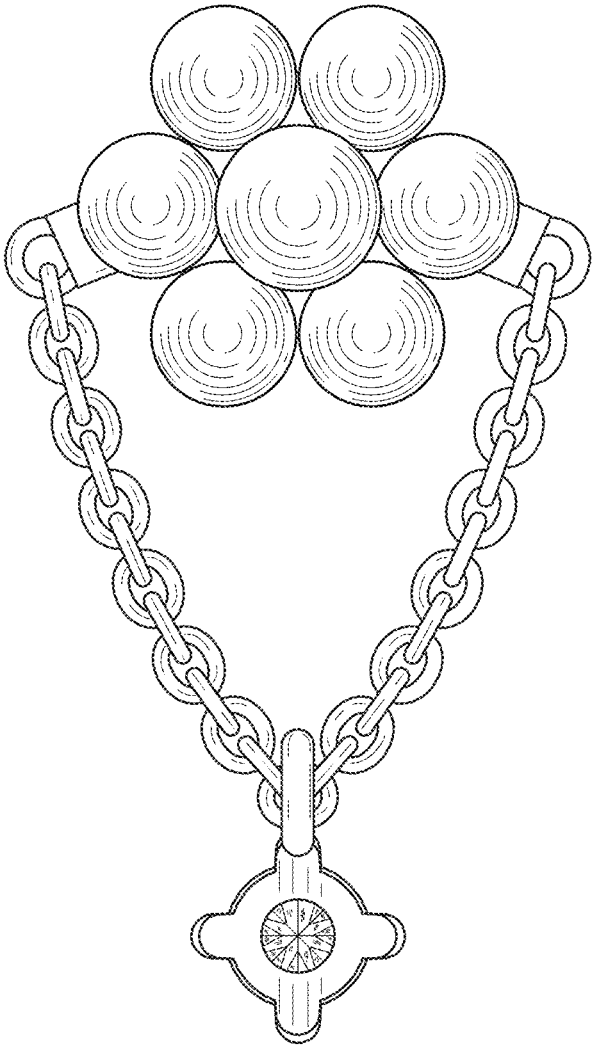
Figure 32:
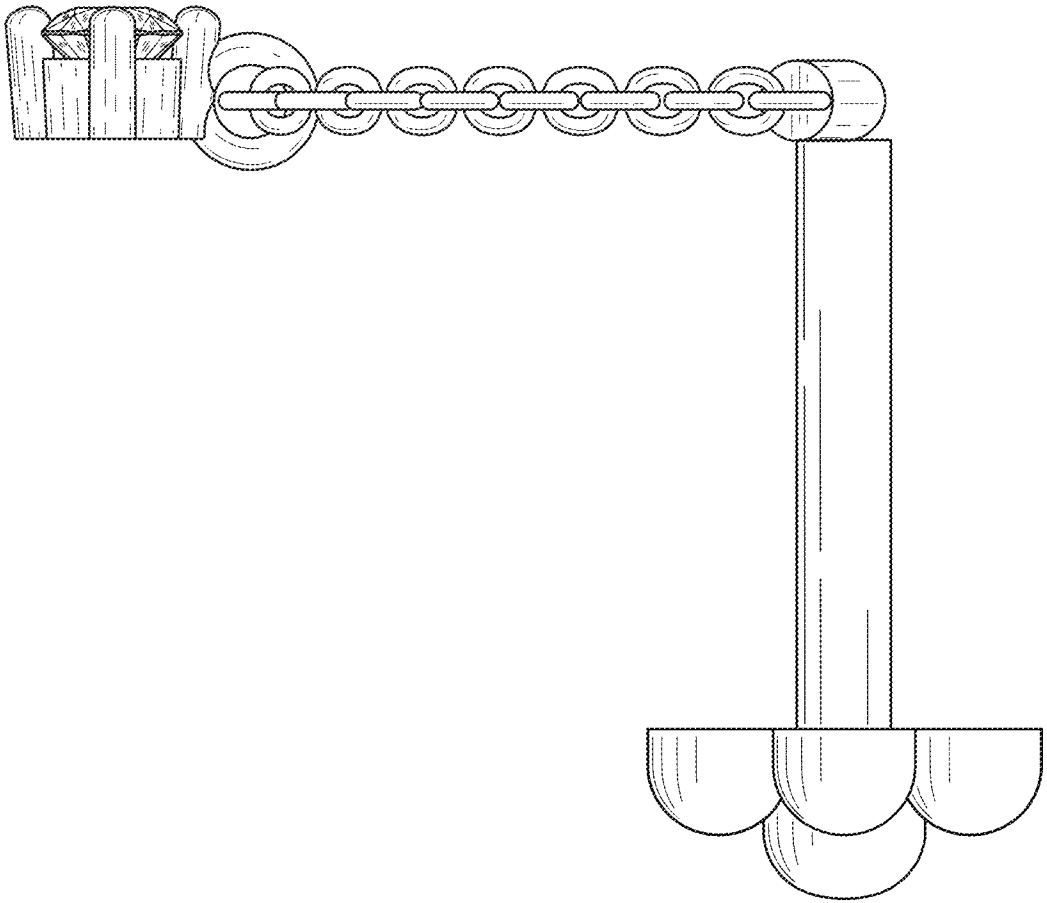
Figure 33:
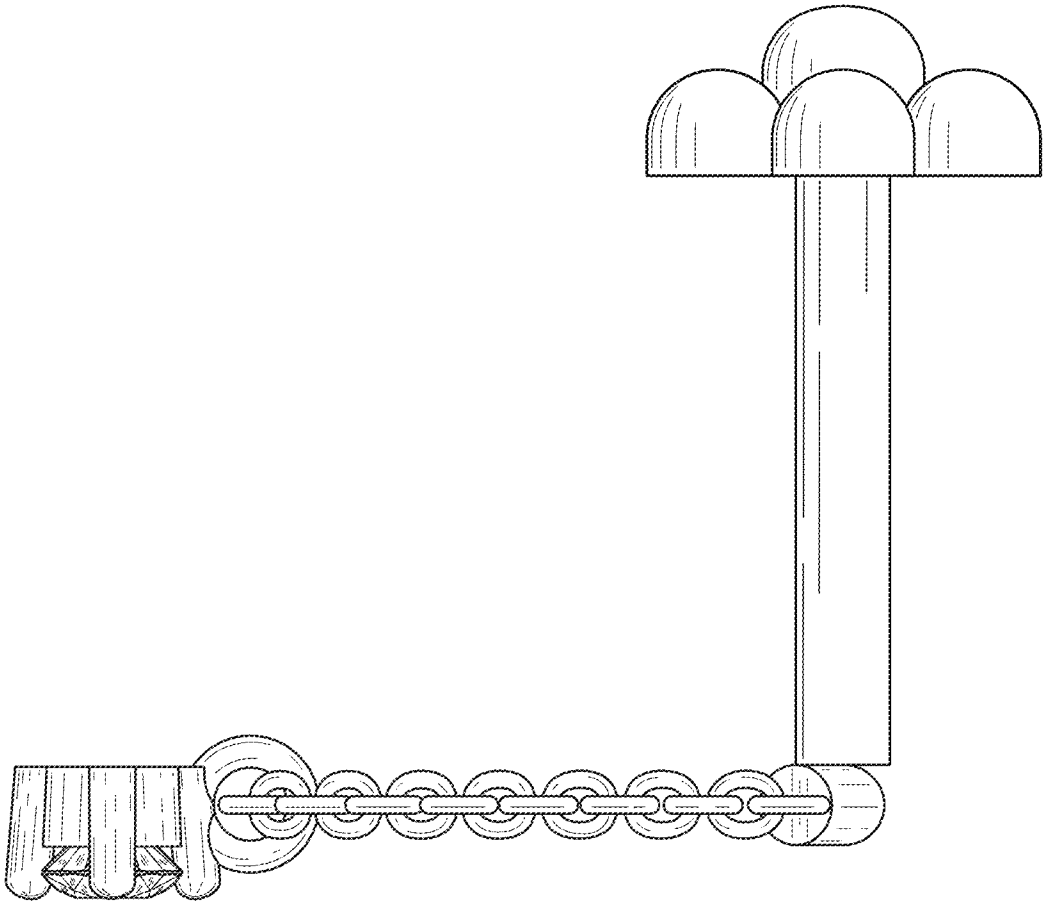
Figure 34:
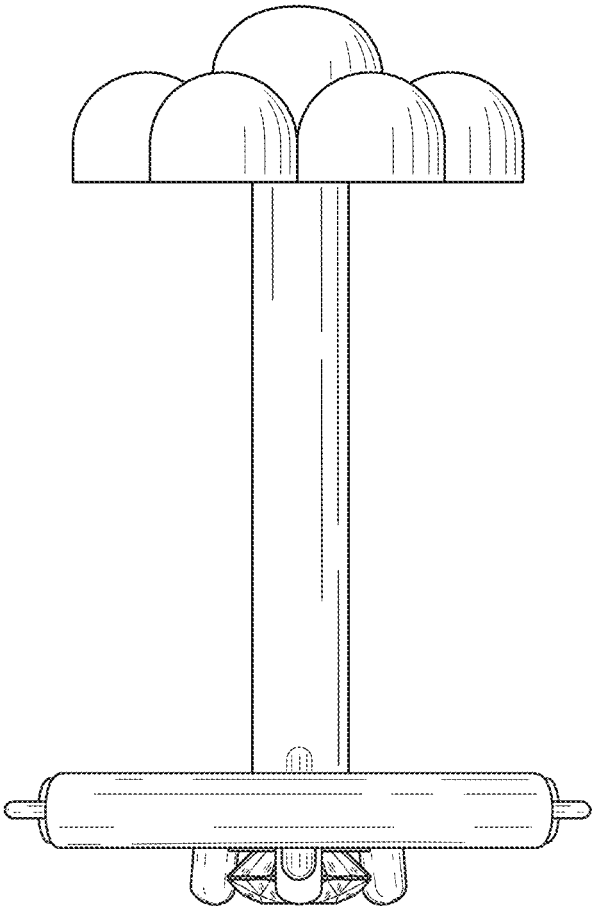
Figure 35:
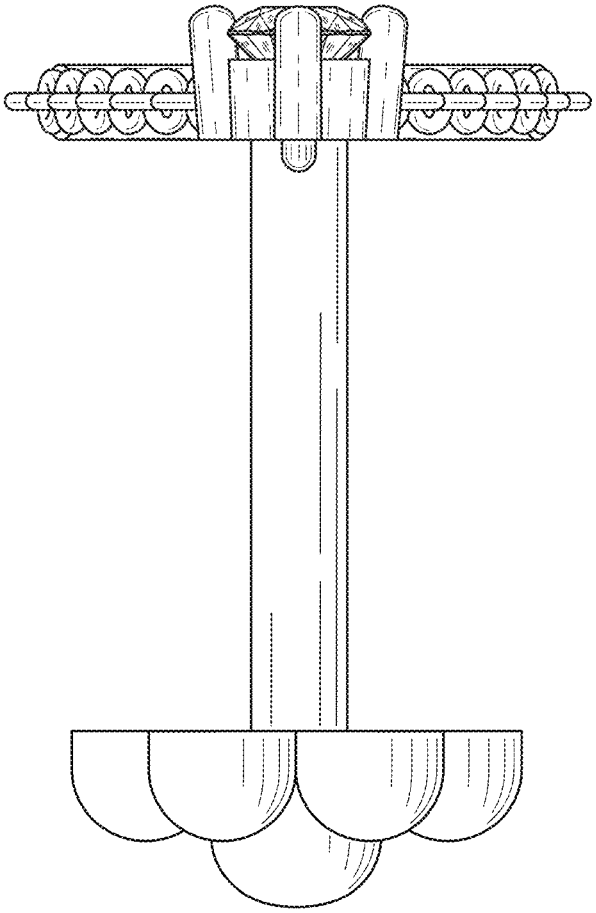

When the line 104 is parabolically suspended from the arcuate member 102, the line 104 has a parabolic vertex about which the line 104 is symmetrical relative to the arcuate member 102 when the line 104 is suspended from the arcuate member 102. Accordingly, as shown in FIG. 8, the post 108 extends from the arcuate member 102 such that the post 108 radially extends away from the parabolic vertex. However, as shown in FIG. 15, the post 108 can also extend from the arcuate member 102 such that the post 108 laterally extends away from the parabolic vertex.

The backing 110 has the tubular member 112 and the end member 114. Each of the tubular member 112 and the end member 114 includes metal (e.g., gold, silver, titanium, copper, brass, nickel, iron, nitinol), but can include other suitable materials (e.g., plastic, rubber, silicon), whether identical or non-identical to each other. Each of the tubular member 112 and the end member 114 is rigid (e.g., cannot be bent or flexed manually by hand), but can be flexible (e.g., can be manually bent or flexed by hand). The tubular member 112 is cross-sectionally circular, but can be cross-sectionally oval, square, rectangular, triangular, pentagonal, octagonal, D-shaped, U-shaped, V-shaped, J-shaped, or others. Each of the tubular member 112 and the end member 114 a single monolithic piece (e.g., additively manufactured, subtractively manufactured, cast, injection molded), but can also be an assembly of pieces secured to each other (e.g., fastening, mating, interlocking, hook-and-looping, magnetizing, adhering). The tubular member 112 and the end member 114 are monolithic with each other (e.g., additively manufactured, subtractively manufactured, cast, injection molded), but can also be assembled with each other (e.g., fastening, mating, interlocking, hook-and-looping, magnetizing, adhering). The end member 114 is embodied as a flower, but can other shapes are possible (e.g., a geometric shape, a flora shape, a fauna shape, an animal shape, a character shape).

The tubular member 112 is internally hollow such that the post 108 can extend thereinto based on the post 108 being inserted into the tubular member 112 or vice versa. The tubular member 112 can be internally threaded and the post 108 can be externally threaded such that the tubular member 112 and the post 108 can removably fasten to each other. However, note that other forms of securing can be used. For example, the tubular member 112 or the post 112 can be magnetized such that the tubular member 112 and the post 108 can removably magnetize to each other. If the earring 100 is worn on the ear, then the post 108 extends through the ear and exits out of the ear such that the tubular member 112 receives the post 108 and secures to the post 108 or vice versa. Note that the tubular member 112 may be open on both ends or open on one end only.

Figure 36:
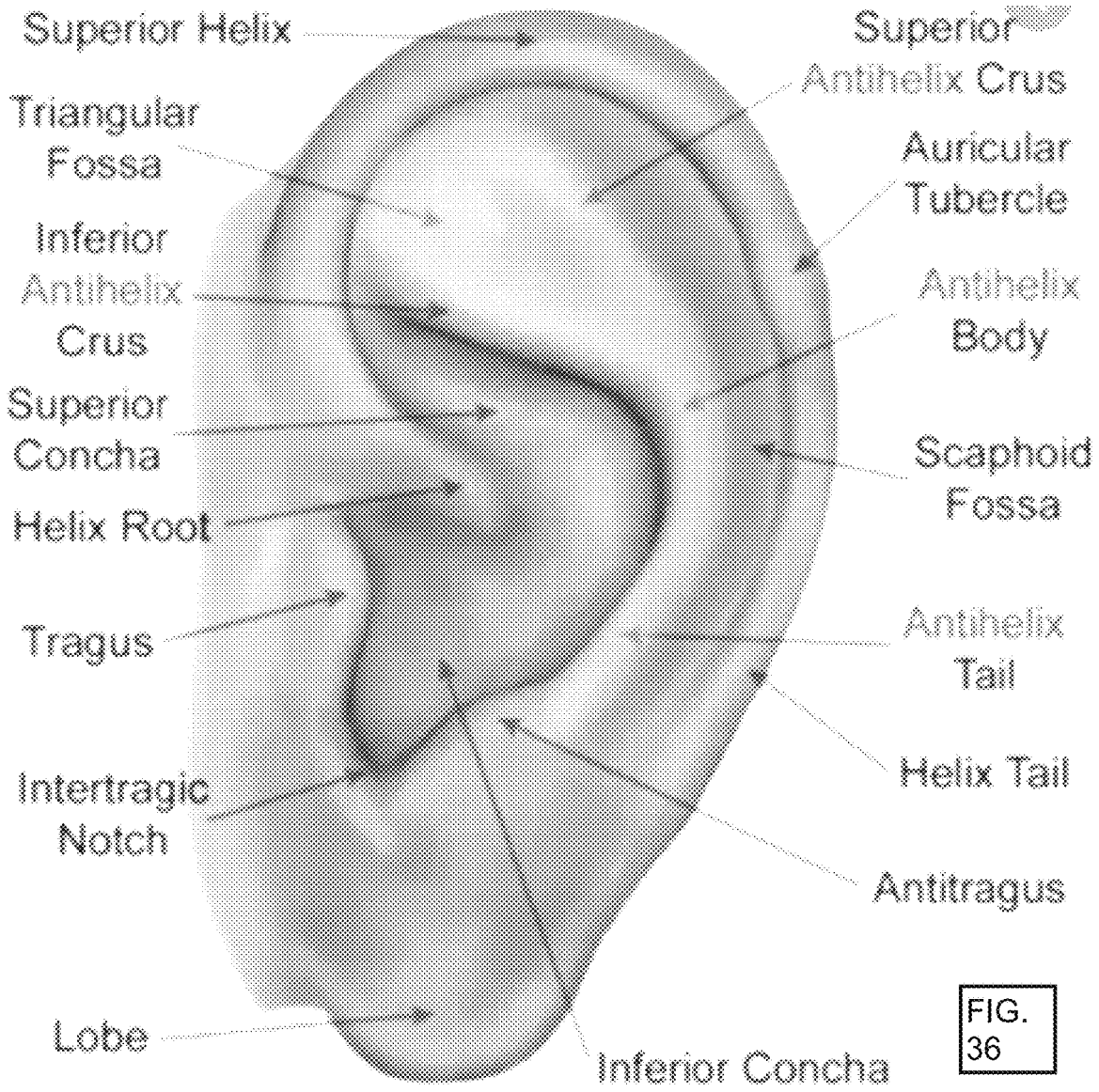
FIGS. 36 and 37 show a map of an outer ear according to this disclosure.
Figure 37:
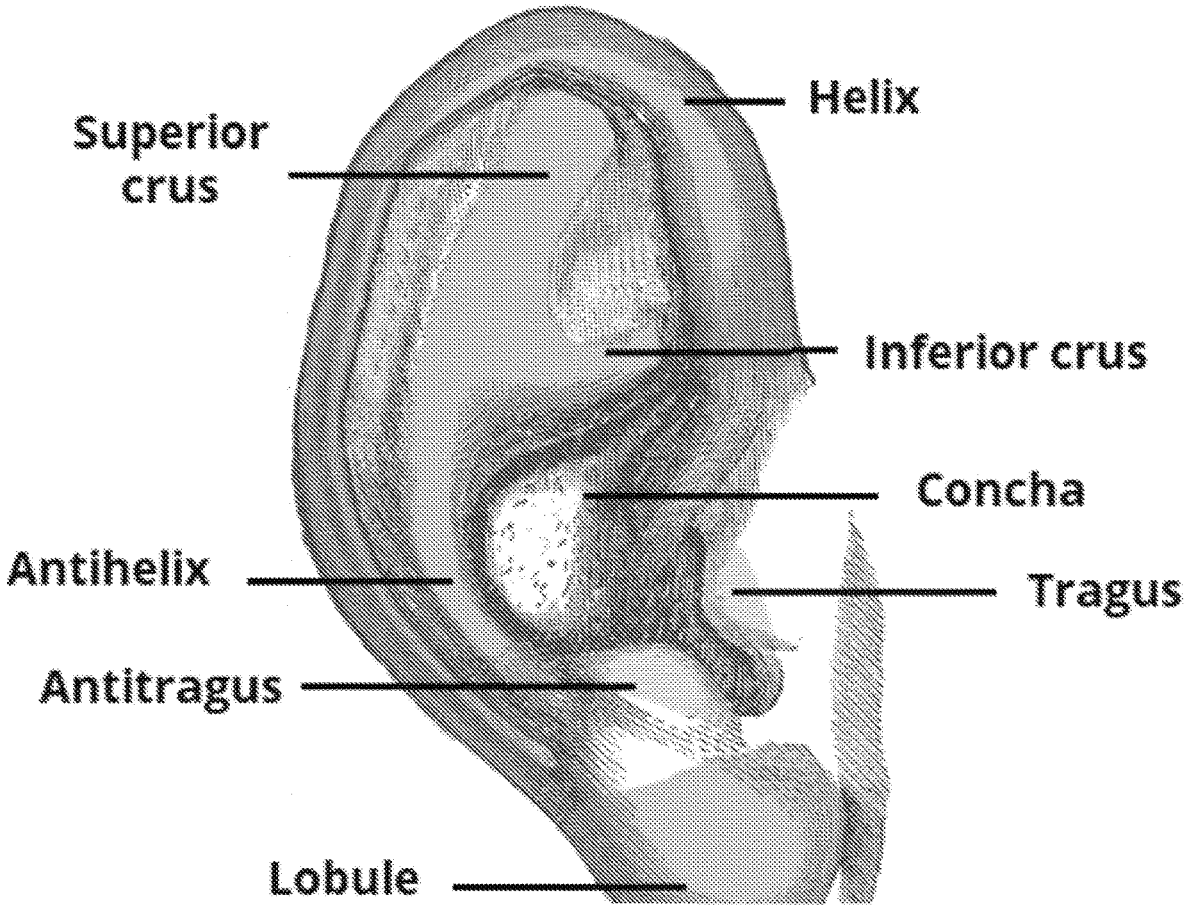
Figure 50:
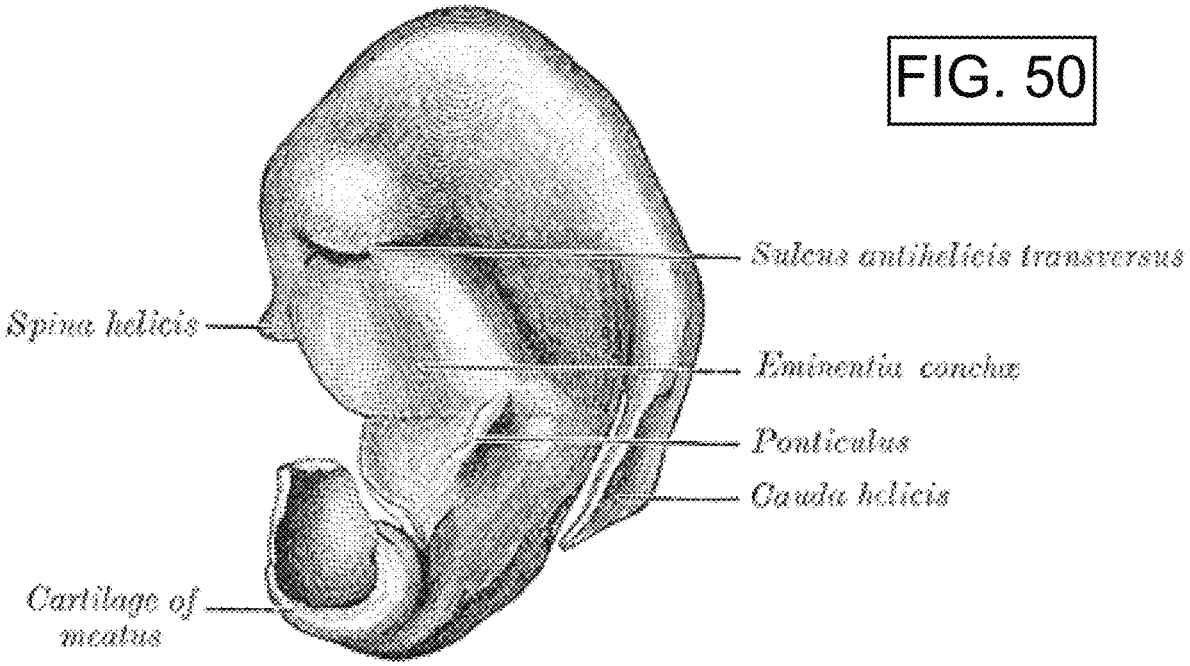
FIG. 50 shows a map of an obverse side of an ear according to this disclosure.
Figure 51:
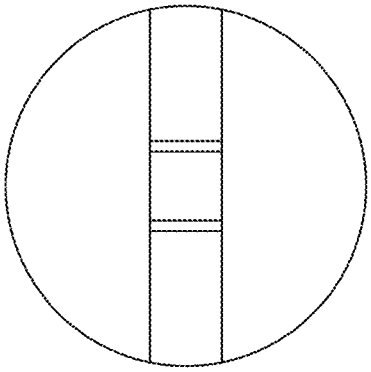
FIGS. 51-92 show a plurality of embodiments of a plurality of components for a plurality of earrings and a plurality of earrings with the components according to this disclosure.
Figure 52:
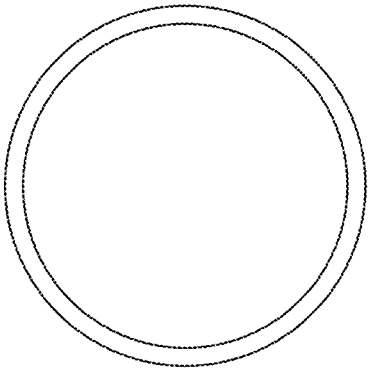
Figure 53:
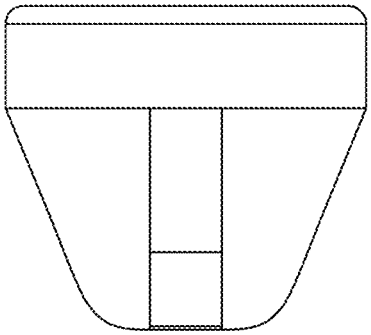
Figure 54:
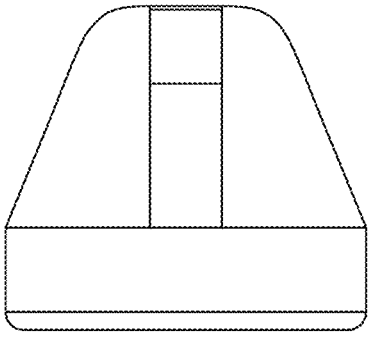
Figure 55:
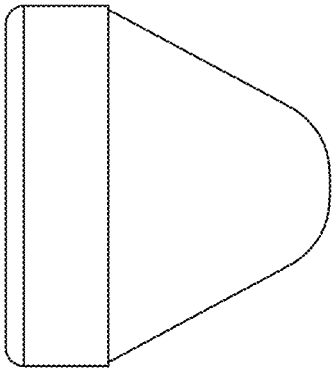
Figure 56:
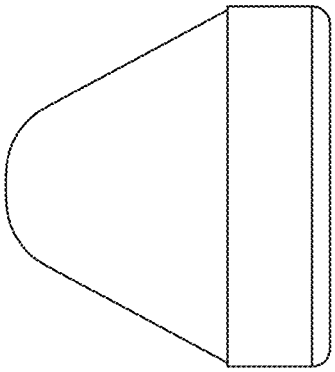
Figure 57:
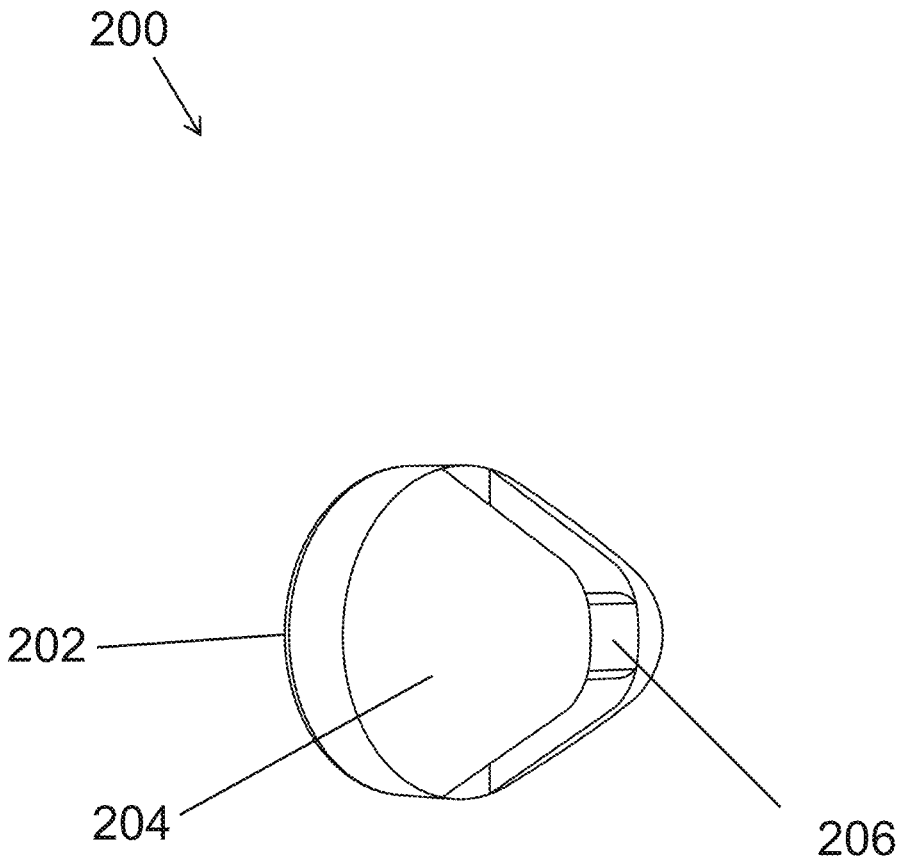
Figure 58:
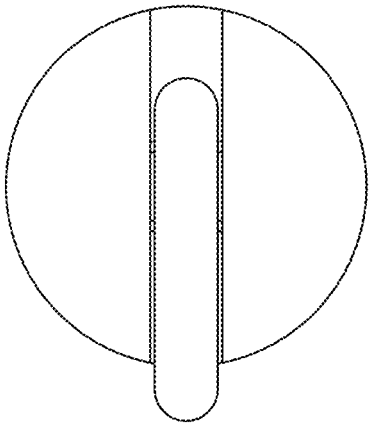
Figure 59:
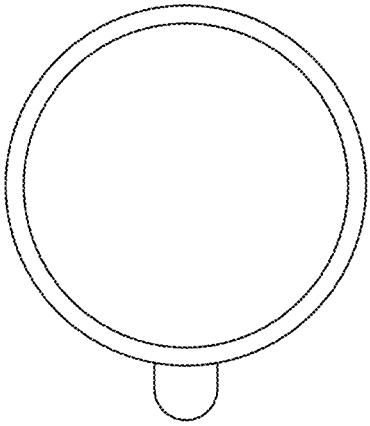
Figure 60:
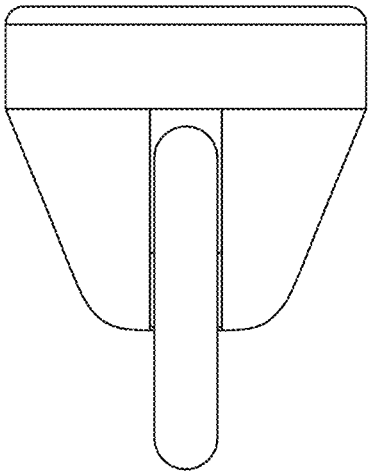
Figure 61:
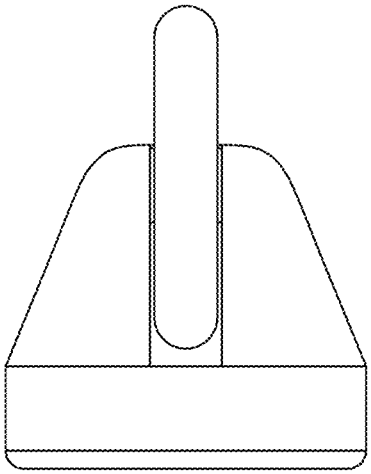
Figure 62:
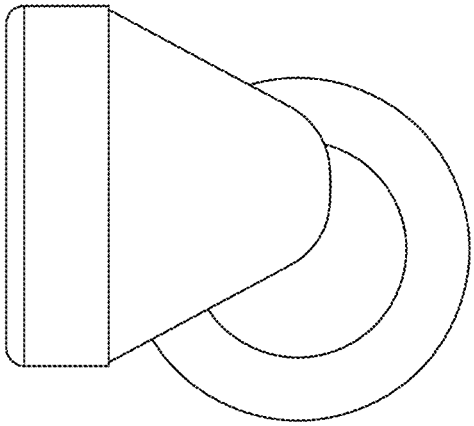
Figure 63:
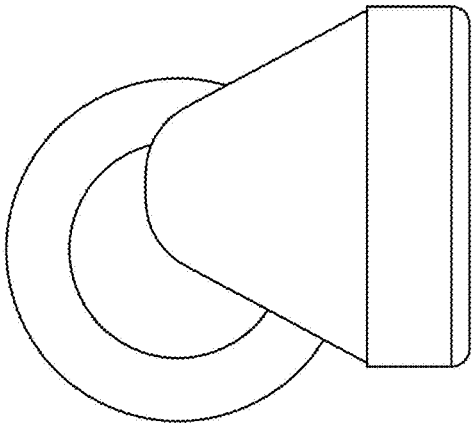
Figure 64:
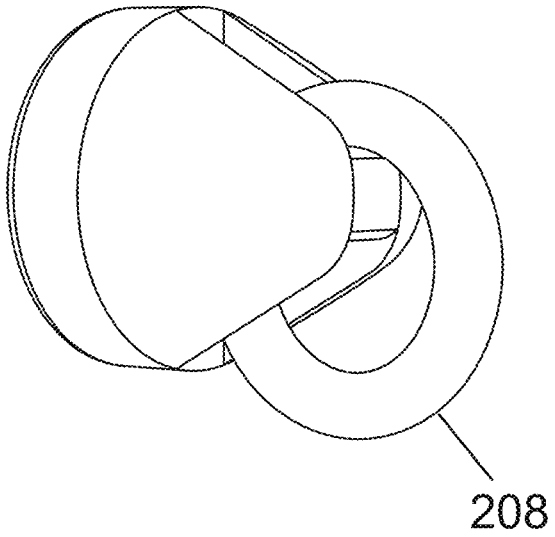
Figure 65:
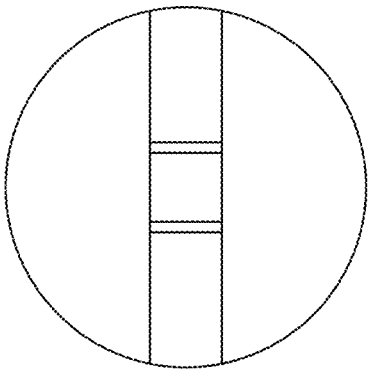
Figure 66:
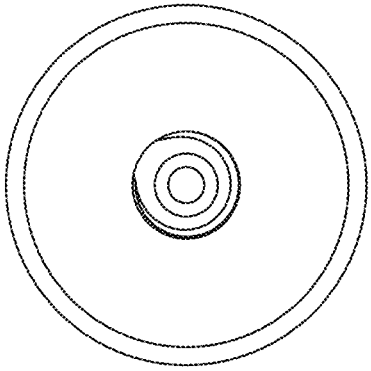
Figure 67:
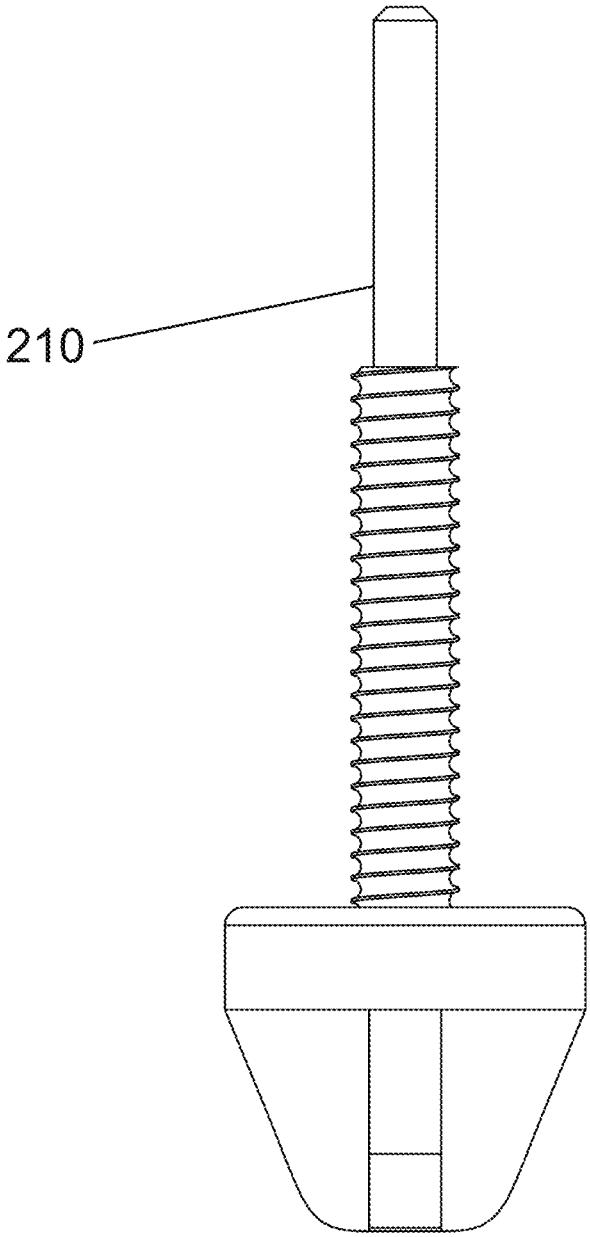
Figure 68:
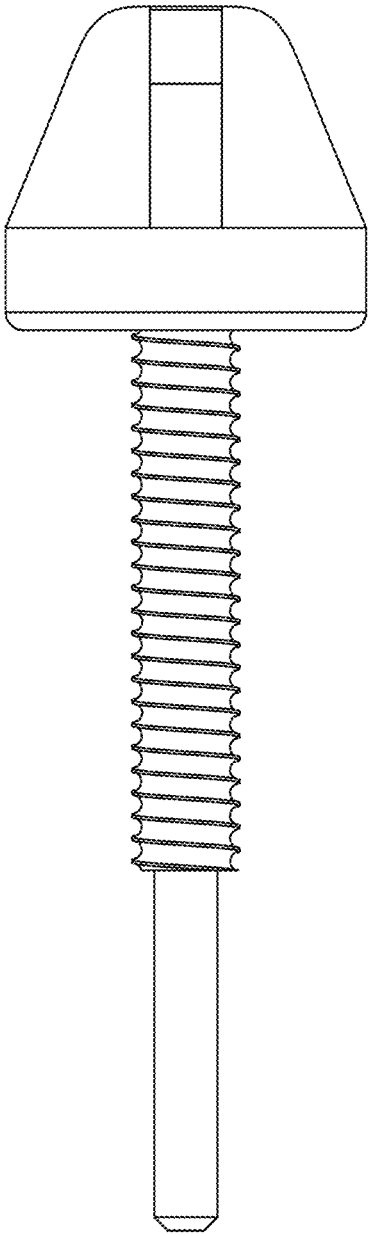
Figure 69:
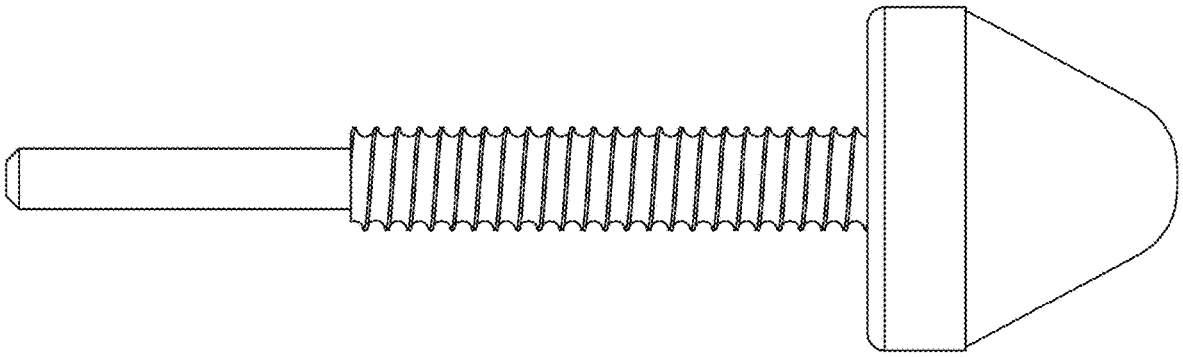
Figure 70:
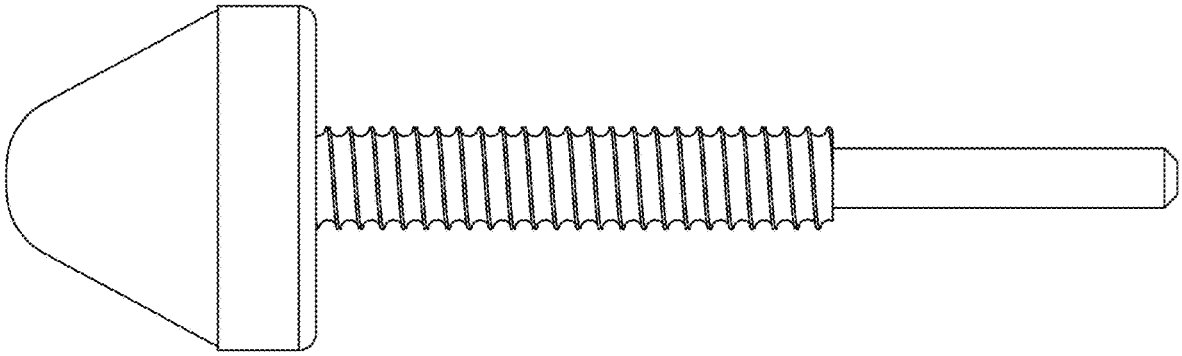
Figure 71:
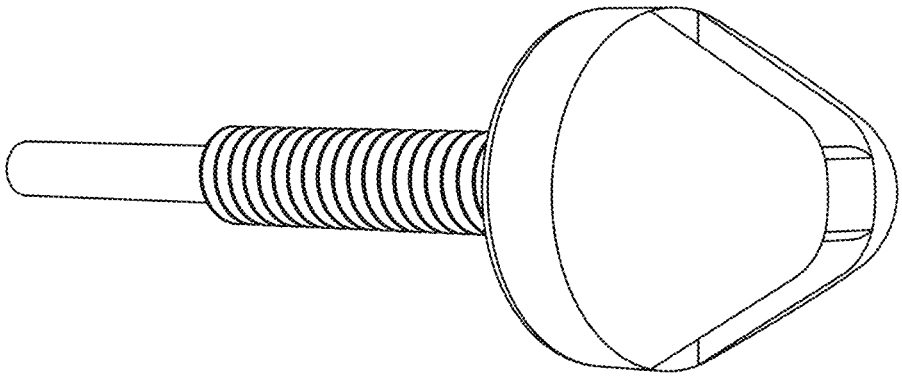
Figure 72:
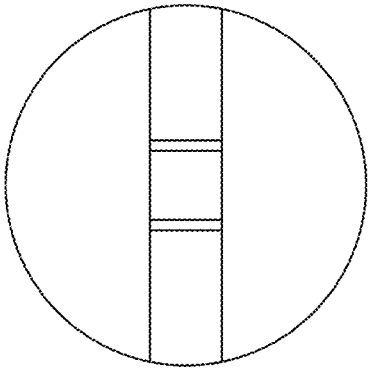
Figure 73:
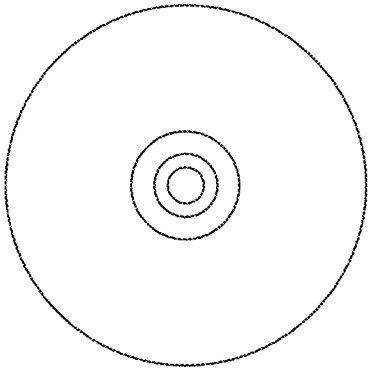
Figure 74:
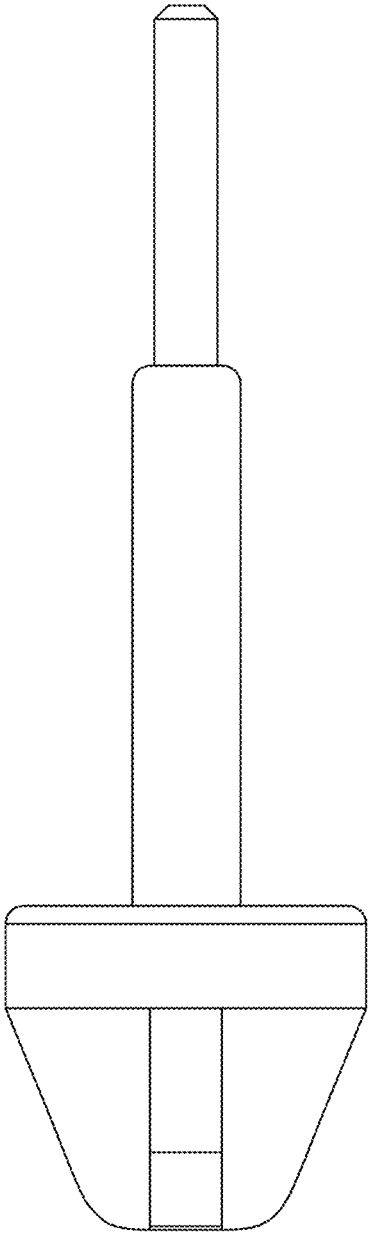
Figure 75:
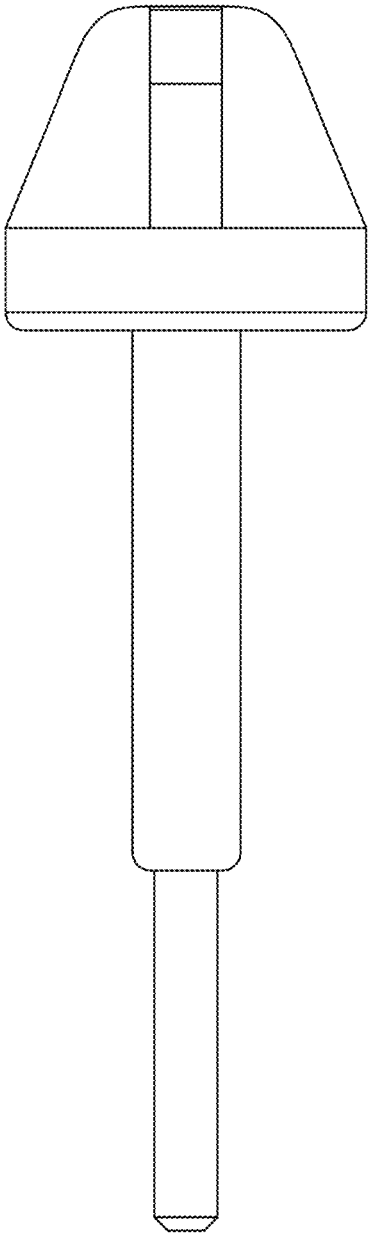
Figure 76:
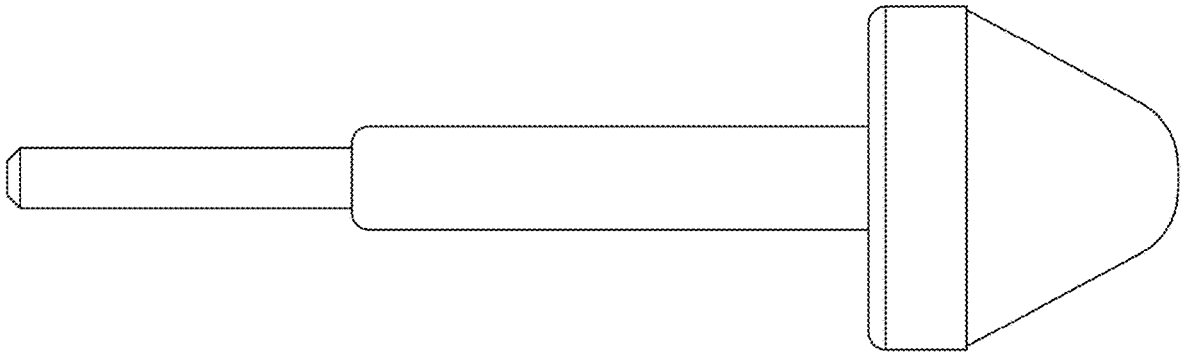
Figure 77:
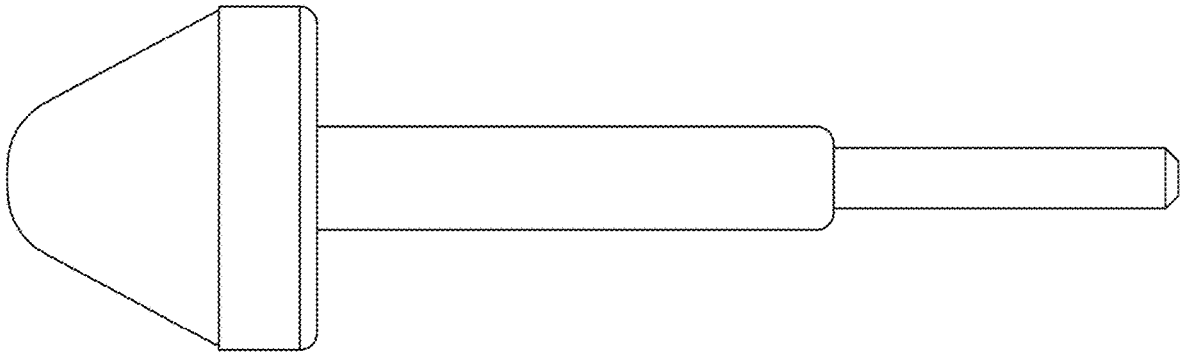
Figure 78:
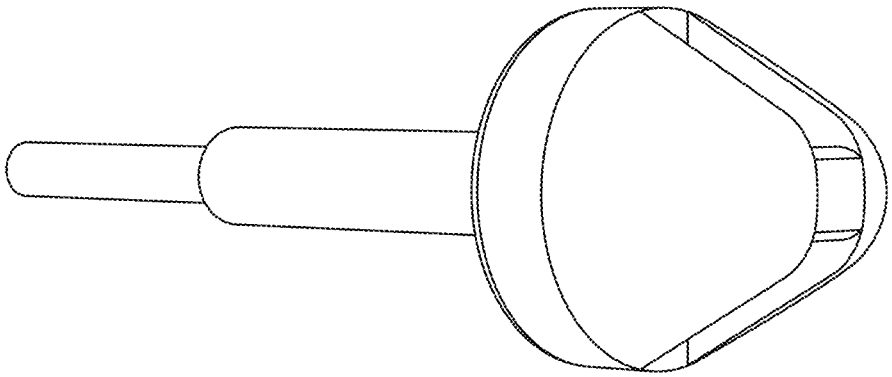
Figure 79:
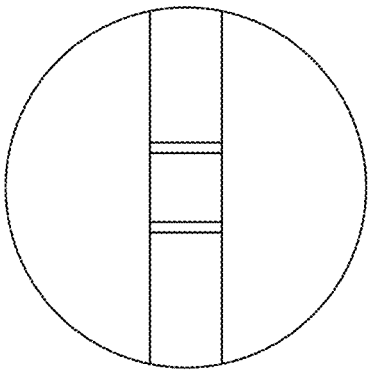
Figure 80:
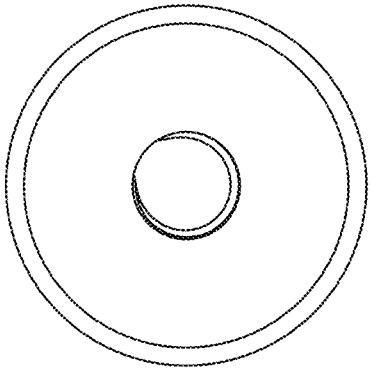
Figure 81:
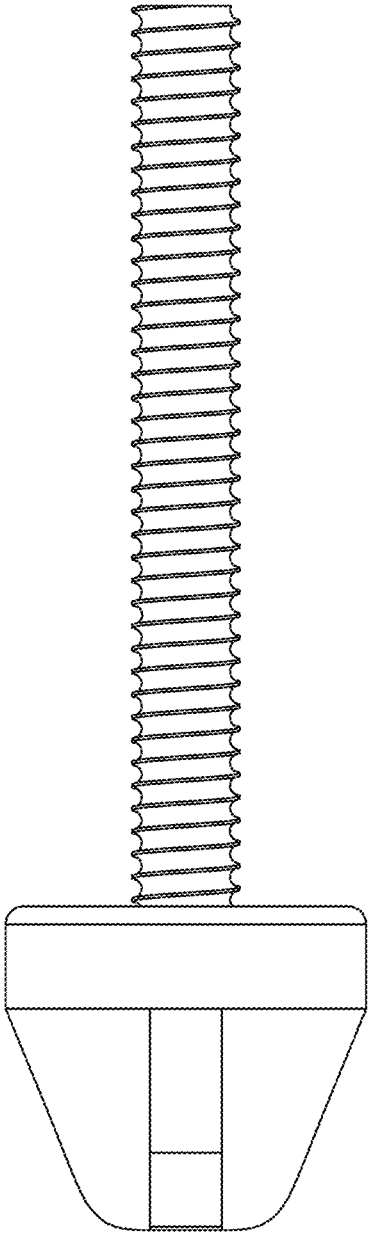
Figure 82:
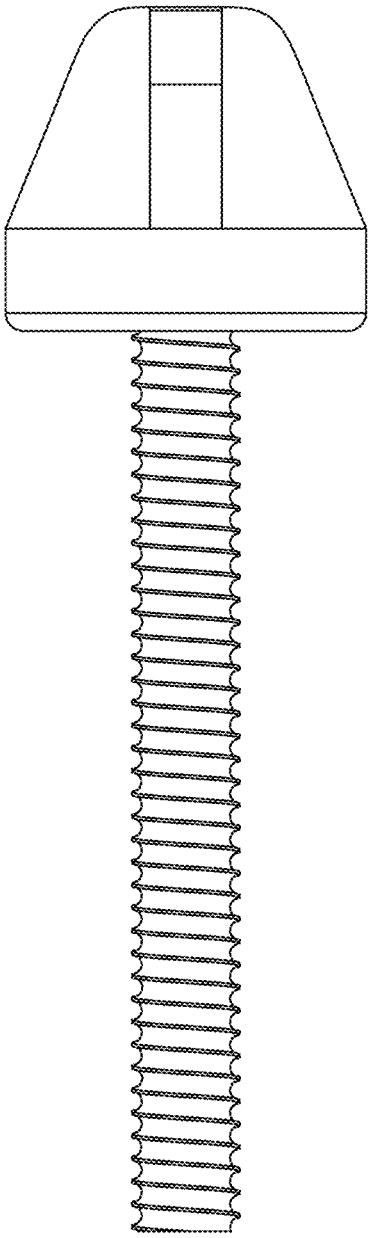
Figure 83:
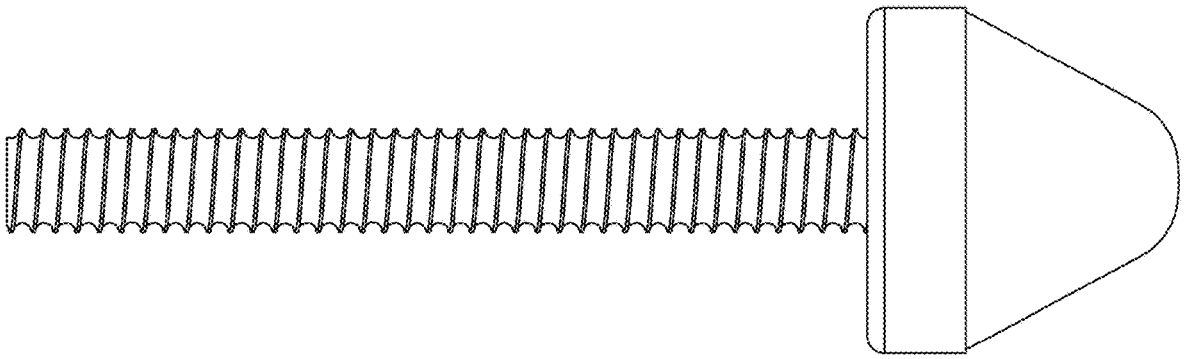
Figure 84:
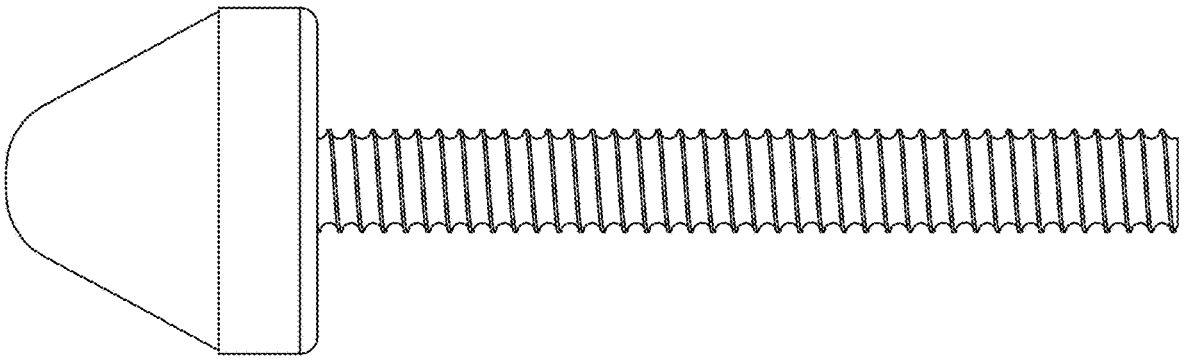
Figure 85:
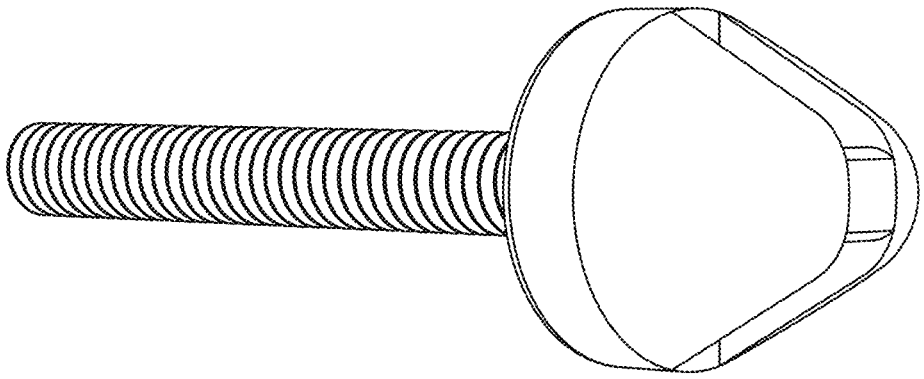
Figure 86:
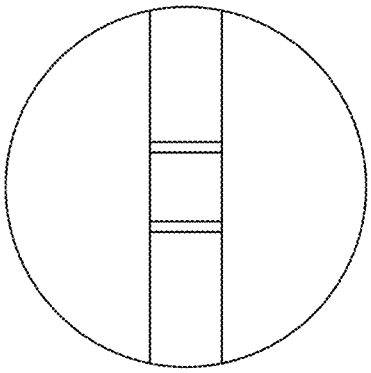
Figure 87:
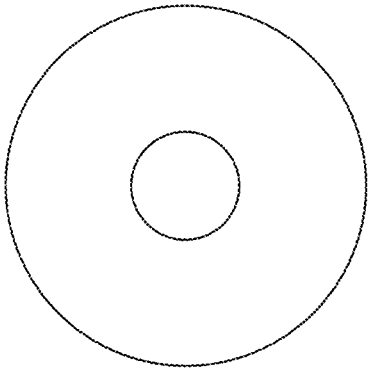
Figure 88:
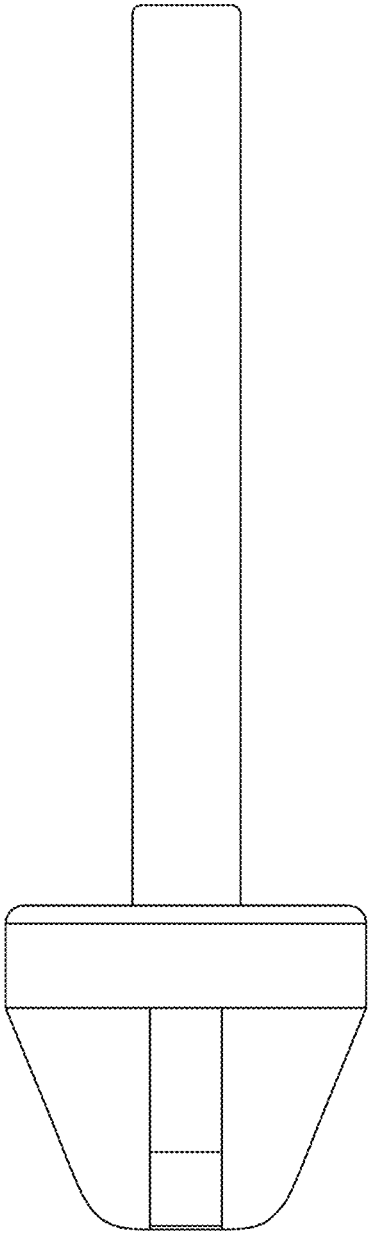
Figure 89:
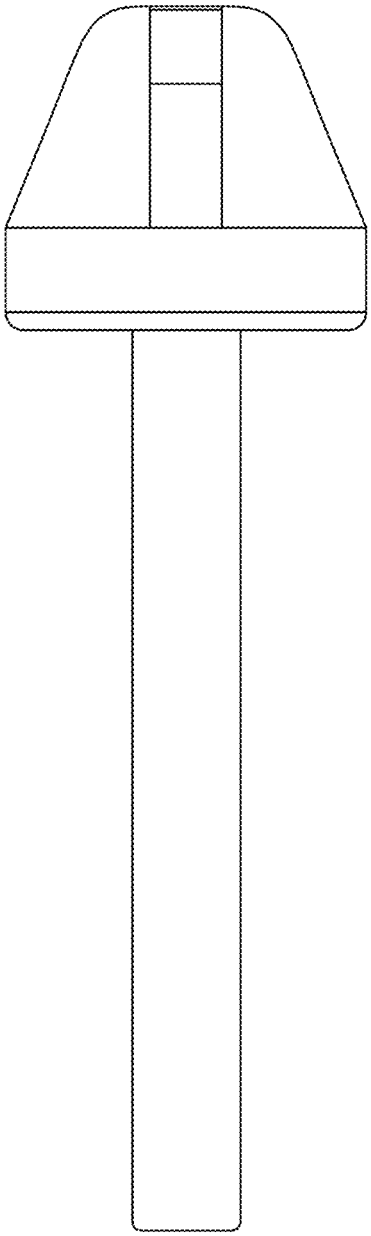
Figure 90:
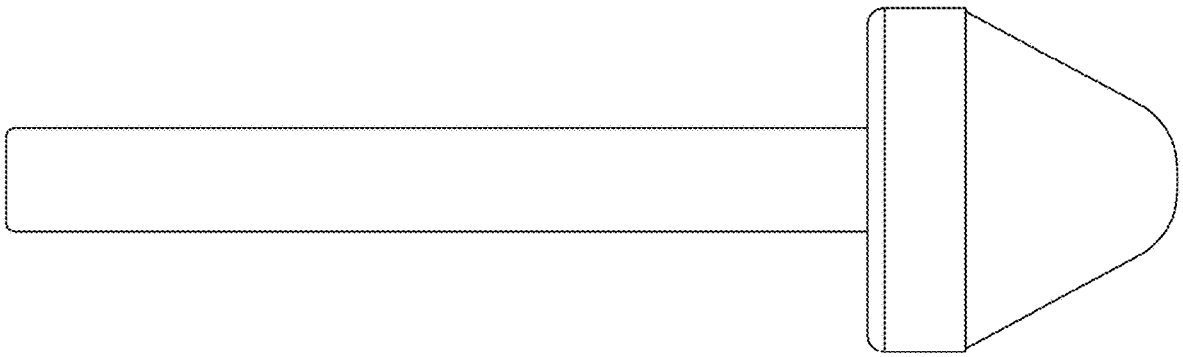
Figure 91:
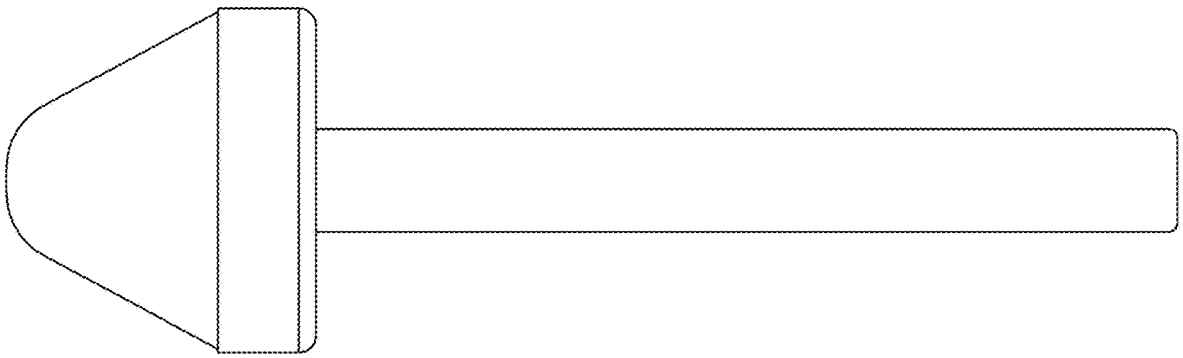
Figure 92:
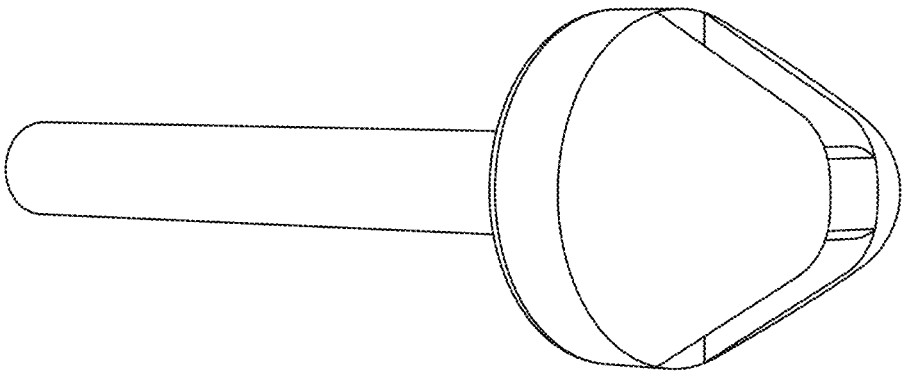

FIGS. 36 and 37 show a map of an outer ear according to this disclosure. FIG. 50 shows a map of an obverse side of an ear according to this disclosure. Based on these maps, FIGS. 38-43 shows a plurality of embodiments of piercing a helix and piercing a superior concha according to this disclosure. In particular, when the earring 100 has the line 104, then the earring 100 can provide a floating effect to enable a "drape piercing." This form of piercing can be done (a) in the superior concha (upper concha) of the ear hidden by an inferior crus of an antihelix of the ear, or (b) in a bowl of the helix of the ear (covered by a superior helix of the ear). For example, to pierce the helix, an upper helix tissue of the ear is lifted and a piercing needle (e.g., rectilinear, non-rectilinear, arcuate) is placed underneath. This can be referred to as a Tash Helix™. For example, to pierce the superior concha piercing, a tissue of the inferior crus of the antihelix is lifted and a piercing needle (e.g., rectilinear, non-rectilinear, arcuate) is placed underneath, in the superior concha. This is referred to as a Tash Hidden Rook™. For example, these embodiments enable a technique of causing the ear to be pierced such that the hole in the helix of the ear or the superior concha of the ear is formed, where the hole is respectively anatomically covered by a superior helix of the ear or an inferior antihelix crus of the ear such that the hole is respectively anatomically hidden by the superior helix of the ear or the inferior antihelix crus of the ear when the ear is viewed frontally straight-on. Then, the technique enables causing the post of the earring to be inserted into the hole such that the earring is coupled to the ear via the post and the post is respectively anatomically hidden by the superior helix of the ear or the inferior antihelix crus of the ear when the ear is viewed frontally straight-on. For example, the ear can be pierced such that the hole exits on an eminentia conchae when the obverse side is viewed frontally straight-on. Note that the ear to be pierced by injecting the piercing needle horizontally, diagonally, or vertically when the ear is viewed frontally straight-on.

As shown in FIGS. 39 and 40, in order pierce the superior concha, the tissue of the inferior crus is lifted and the piercing needle is pushed straight up for a vertical piercing angle or straight back for a horizontal piercing angle. Therefore, when the earring 100 is used, this form of piercing results in the line 104 as having a floating effect, where the line 104 appears as to be floating in the ear. This occurs based on a hole being anatomically covered by the inferior crus of the antihelix of the ear such that the hole is anatomically hidden by the inferior crus of the antihelix of the ear when the ear is viewed frontally straight-on. Therefore, based on the hole being anatomically covered by the inferior crus of the antihelix of the ear such that the hole is anatomically hidden by the inferior crus of the antihelix of the ear when the ear is viewed frontally straight-on, the arcuate member 102 (or another member) is also anatomically covered by the inferior crus of the antihelix of the ear such that the arcuate member 102 (or another member) is anatomically hidden by the inferior crus of the antihelix of the ear when the ear is viewed frontally straight-on. Resultantly, as shown in FIG. 41, since each of the hole and the arcuate member 102 (or another member) is anatomically covered by the inferior crus of the antihelix of the ear such that the hole is anatomically hidden by the inferior crus of the antihelix of the ear when the ear is viewed frontally straight-on, the line 104 has a floating effect and thereby appears floating and precludes a bystander from readily comprehending how the earring 100 is attached to the ear of the wearer when the bystander views the ear of the wearer frontally straight-on. As shown, the earring 100 can therefore include the arcuate member 102 (or another member) extending from the post such that the arcuate member 102 is respectively anatomically covered by the superior helix of the ear or the inferior antihelix crus of the ear such that the arcuate member 102 is respectively anatomically hidden by the superior helix of the ear or the inferior antihelix crus of the ear when the ear is viewed frontally straight-on. Likewise, since the earring 100 includes the line 104 suspended from the member, the line 104 is not respectively anatomically covered by the superior helix of the ear or the inferior antihelix crus of the ear such that the line 104 is not respectively anatomically hidden by the superior helix of the ear or the inferior antihelix crus of the ear when the ear is viewed frontally straight-on. For example, the ear can be pierced such that the hole exits on an eminentia conchae when the obverse side is viewed frontally straight-on. Note that the ear to be pierced by injecting the piercing needle horizontally, diagonally, or vertically when the ear is viewed frontally straight-on.

As shown in FIGS. 42 and 43, in order to pierce the helix, an upper flap of the helix is lifted and the piercing needle is placed at a high point and pushed straight back for a horizontal piercing angle or straight up for a vertical piercing angle. This occurs based on a hole being anatomically covered by the superior helix of the ear such that the hole is anatomically hidden by the superior helix of the ear when the ear is viewed frontally straight-on. Therefore, based on the hole being anatomically covered by the superior helix of the ear such that the hole is anatomically hidden by the superior helix of the ear when the ear is viewed frontally straight-on, the arcuate member 102 (or another member) is also anatomically covered by the superior helix of the ear such that the arcuate member 102 (or another member) is anatomically hidden by the superior helix of the ear when the ear is viewed frontally straight-on. Resultantly, as shown in FIG. 43, since each of the hole and the arcuate member 102 (or another member) is anatomically covered by the superior helix of the ear such that the hole is anatomically hidden by the superior helix of the ear when the ear is viewed frontally straight-on, the line 104 has a floating effect and thereby appears floating and precludes a bystander from readily comprehending how the earring 100 is attached to the ear of the wearer when the bystander views the ear of the wearer frontally straight-on. As shown, the earring 100 can therefore include the arcuate member 102 (or another member) extending from the post such that the arcuate member 102 is respectively anatomically covered by the superior helix of the ear or the inferior antihelix crus of the ear such that the arcuate member 102 is respectively anatomically hidden by the superior helix of the ear or the inferior antihelix crus of the ear when the ear is viewed frontally straight-on. Likewise, since the earring 100 includes the line 104 suspended from the member, the line 104 is not respectively anatomically covered by the superior helix of the ear or the inferior antihelix crus of the ear such that the line 104 is not respectively anatomically hidden by the superior helix of the ear or the inferior antihelix crus of the ear when the ear is viewed frontally straight-on. For example, the ear can be pierced such that the hole exits on an eminentia conchae when the obverse side is viewed frontally straight-on. Note that the ear to be pierced by injecting the piercing needle horizontally, diagonally, or vertically when the ear is viewed frontally straight-on.

FIG. 44 shows a plurality of embodiments of a plurality of earrings for coupling to an ear when the ear is pierced at a helix or a superior concha according to this disclosure. Note that these earrings are structured based on earring 100 and how the post 108 extends (radially or laterally) depends on how the ear is pierced (e.g., location, angle) and how the earring 100 is structured.

FIG. 45 shows a plurality of embodiments of a post exiting an obverse side of an ear according to this disclosure. Note that the post 108 extends from an eminentia conchae of the obverse side of the ear when the helix or the concha are pierced, as disclosed herein. For example, the post 108 can extend into the tubular member 112 over the obverse side when the ear is viewed frontally straight-on. For example, the post 108 can be secured to the tubular member 112 when the post 108 extends into the tubular member 112 over the obverse side when the ear is viewed frontally straight-on. For example, the ear can be pierced such that the hole exits on an eminentia conchae when the obverse side is viewed frontally straight-on. Note that the ear to be pierced by injecting the piercing needle horizontally, diagonally, or vertically when the ear is viewed frontally straight-on.

Figure 46:
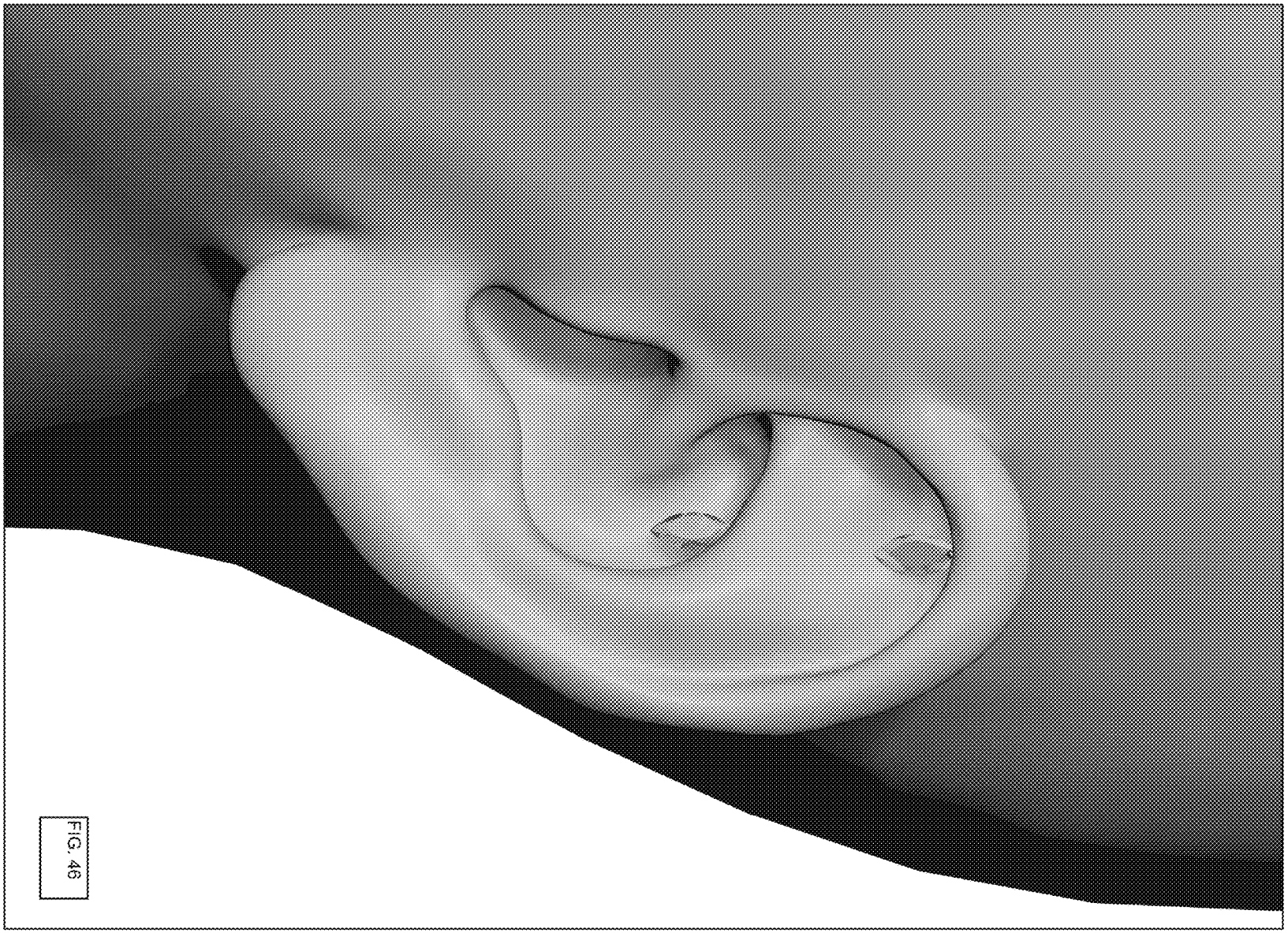
FIGS. 46 and 47 show a plurality of embodiments of a plurality of earrings for coupling to an ear when the ear is pierced at a helix or a superior concha according to this disclosure.
Figure 47:
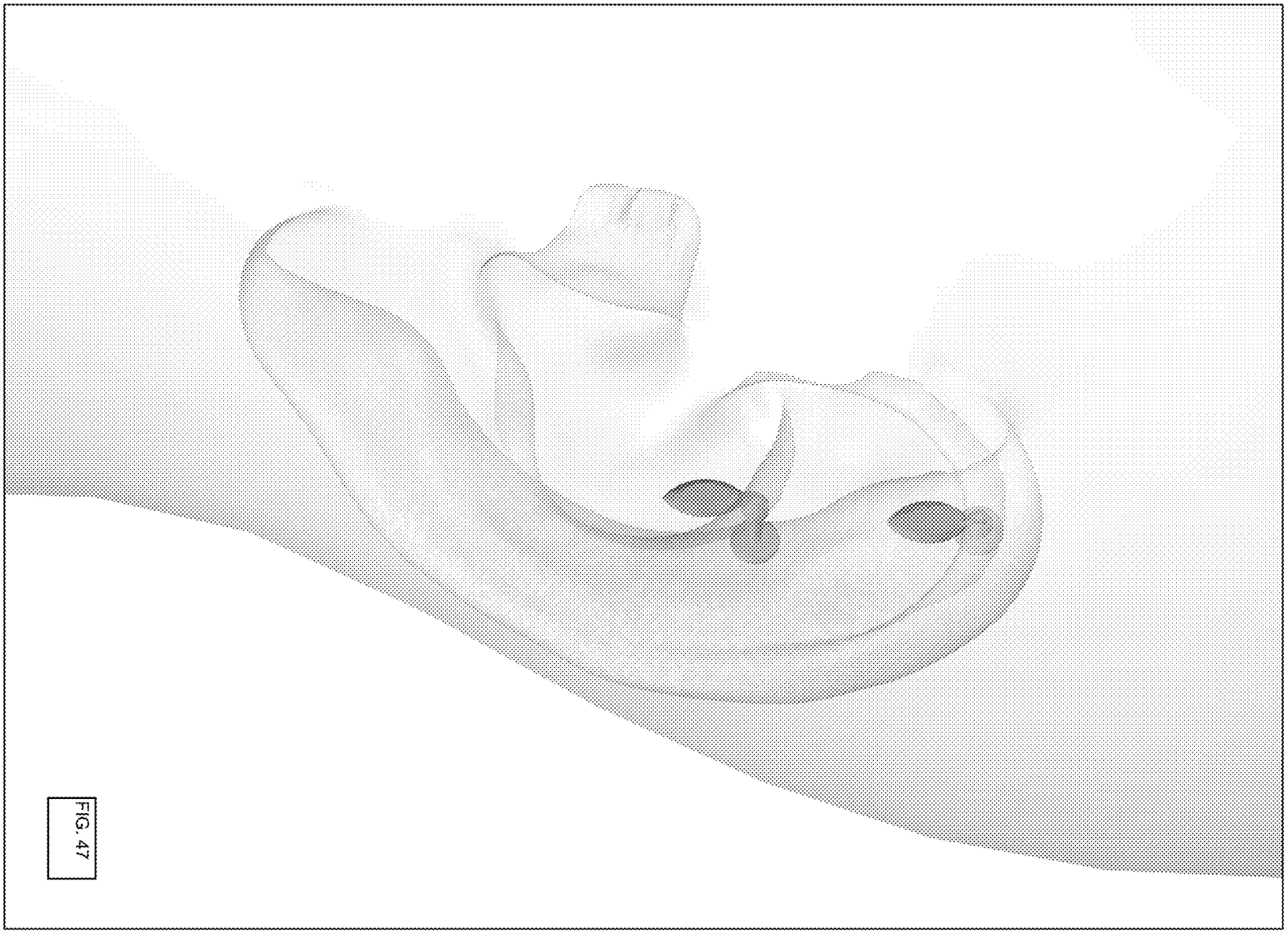

FIGS. 46 and 47 show a plurality of embodiments of a plurality of earrings for coupling to an ear when the ear is pierced at a helix or a superior concha according to this disclosure. Note that these earrings do not employ the arcuate member 104 (although that is possible). Instead each of these earrings has a sphere (or another geometrical shape) secured to a distal end of the post 108 on a front side of the ear and there is a dangling element or a stone secured or suspended from the sphere. In order to prevent the post 108 from moving within the ear, there is a disc mounted into the post 108 in order to exert pressure or reduce friction between the disc and the backing 110. Although the disc is circular, the disc can be shaped in other ways (e.g., a polygon, a square, a triangle, a closed shape with a plurality of rounded corners). As shown, the earring 100 can therefore include the arcuate member 102 (or another member) extending from the post such that the arcuate member 102 is respectively anatomically covered by the superior helix of the ear or the inferior antihelix crus of the ear such that the arcuate member 102 is respectively anatomically hidden by the superior helix of the ear or the inferior antihelix crus of the ear when the ear is viewed frontally straight-on. For example, the ear can be pierced such that the hole exits on an eminentia conchae when the obverse side is viewed frontally straight-on.

Figure 48:
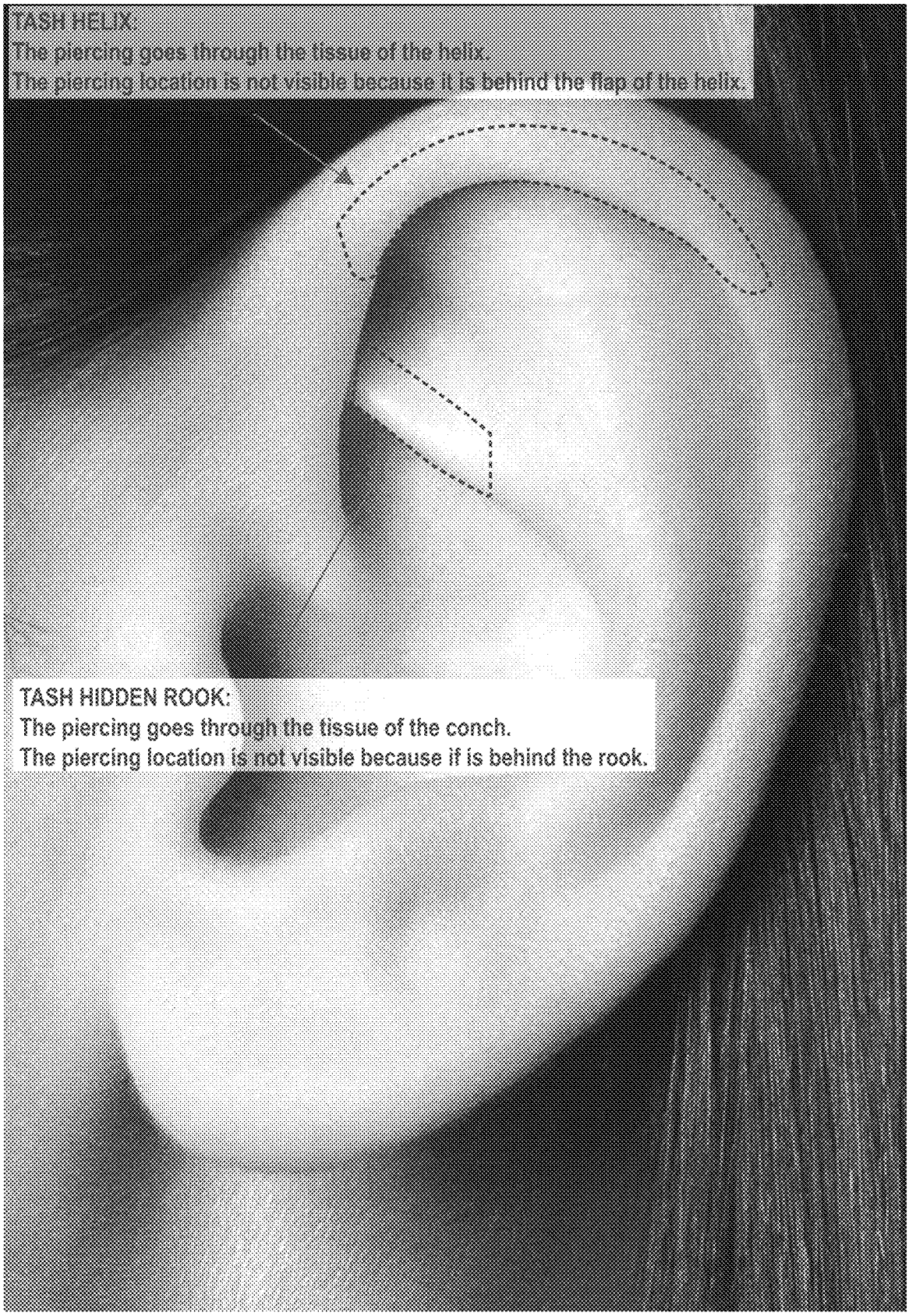
FIG. 48 shows a plurality of locations for piercing a helix when an ear is viewed frontally straight-on and piercing a superior concha when an ear is viewed frontally straight-on according to this disclosure.

FIG. 48 shows a plurality of locations for piercing a helix when an ear is viewed frontally straight-on and piercing a superior concha when an ear is viewed frontally straight-on according to this disclosure. In particular, for piercing the helix, note that the hole is hidden and not visible when frontally viewed straight-on because the hole is covered (positioned behind) the superior helix (flap) of the ear. Likewise, for piercing the superior concha, note that the hole is hidden and not visible when frontally viewed straight-on because the hole is covered (positioned behind) the inferior crus of the antihelix of the ear. For example, the ear can be pierced such that the hole exits on an eminentia conchae when the obverse side is viewed frontally straight-on.

Figure 49:
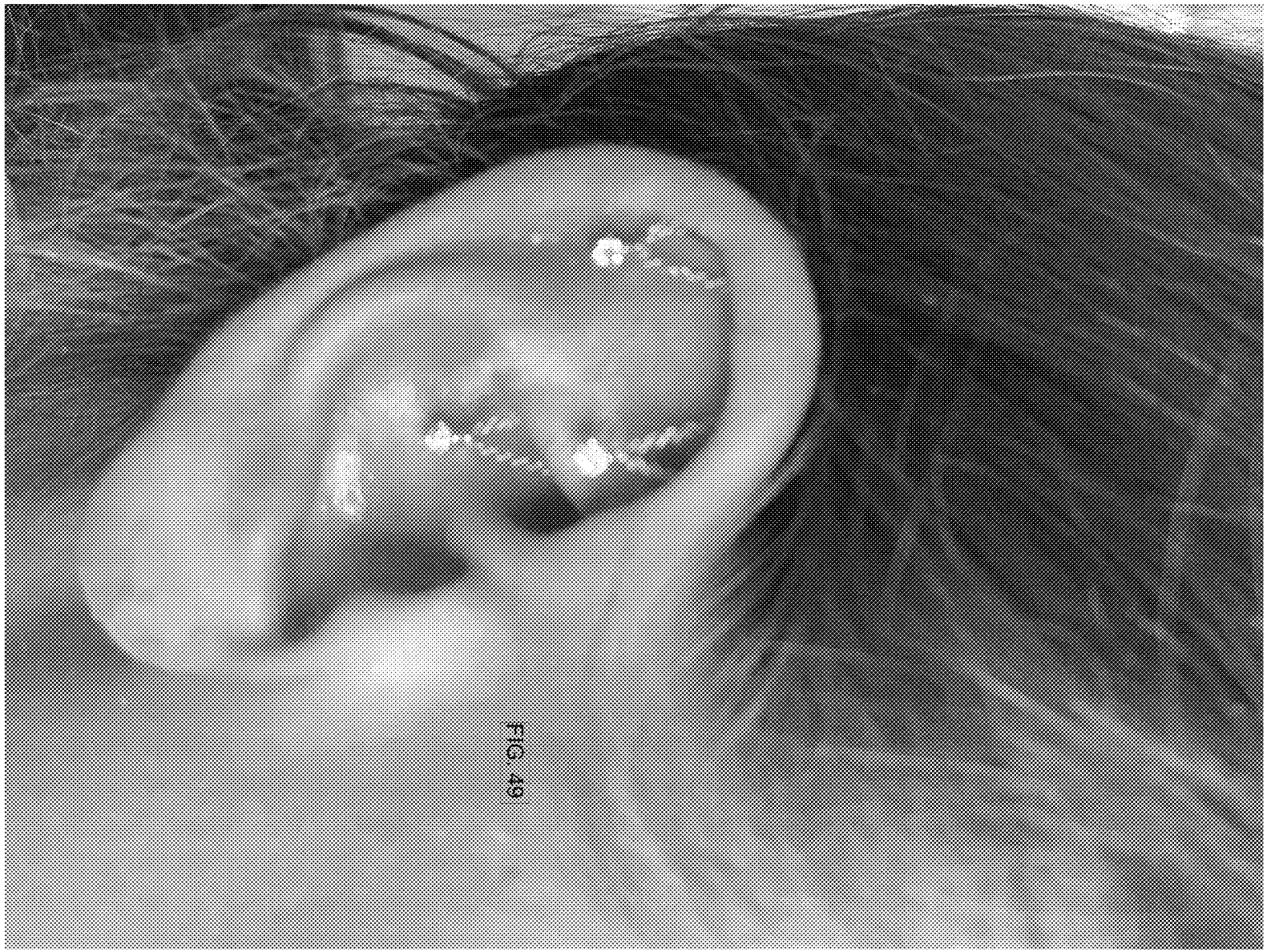
FIG. 49 shows a plurality of embodiments of a plurality of earrings coupled to an ear of a wearer when the ear of the wearer is viewed frontally straight-on after piercing a helix and piercing a superior concha according to this disclosure.

FIG. 49 shows a plurality of embodiments of a plurality of earrings coupled to an ear of a wearer when the ear of the wearer is viewed frontally straight-on after piercing a helix and piercing a superior concha according to this disclosure. Note that the wearer has the helix pierced in at least two different locations on the helix and each of those locations is hidden and not visible when frontally viewed straight-on because the hole is covered (positioned behind) the superior helix (flap) of the ear. Note that those two earrings can also be a single earring where a member (e.g., the arcuate member 102) is hidden and not visible when frontally viewed straight-on because the member is covered (positioned behind) the superior helix (flap) of the ear. Likewise, note that the wearer has the superior concha is pierced and the hole is hidden and not visible when frontally viewed straight-on because the hole is covered (positioned behind) the inferior crus of the antihelix of the ear. As shown, the earring 100 can therefore include the arcuate member 102 (or another member) extending from the post such that the arcuate member 102 is respectively anatomically covered by the superior helix of the ear or the inferior antihelix crus of the ear such that the arcuate member 102 is respectively anatomically hidden by the superior helix of the ear or the inferior antihelix crus of the ear when the ear is viewed frontally straight-on. Likewise, since the earring 100 includes the line 104 suspended from the member, the line 104 is not respectively anatomically covered by the superior helix of the ear or the inferior antihelix crus of the ear such that the line 104 is not respectively anatomically hidden by the superior helix of the ear or the inferior antihelix crus of the ear when the ear is viewed frontally straight-on. For example, the ear can be pierced such that the hole exits on an eminentia conchae when the obverse side is viewed frontally straight-on. Note that if there are more than one line 104 (e.g., two, three, four or more), then these lines 104 can intersect each other or not intersect each other, whether these lines 104 are parabolically suspended from the arcuate member 104 or not parabolically suspended from the arcuate member.

FIGS. 51-92 show a plurality of embodiments of a plurality of components for a plurality of earrings and a plurality of earrings with the components according to this disclosure. In particular, a component 200 includes a base 202 and a plurality of walls 204 spaced apart from each other at the base 202 and extending from the base 202 such that the walls 204 remain spaced apart from each other. The base 202 is disc-shaped, has a flat outermost resting surface, and a flat outermost circumnavigating surface, but these configurations can vary (e.g., non-flat, rough, knurled, non-circular, oval, square). Each of the walls 204 is trapezoidal in shape such that the respective wall 204 narrows in width as the respective wall 204 extends further away from the base 202, although other shaping is possible (e.g., polygonal, triangular, rectangular, semi-circular, oval). Each of the walls 204 has a bulging (e.g., convex) outermost side that is smooth, although non-bulging outermost side is possible. The component 200 further includes a bridge 206 spanning between the walls 204.

The component 200 includes a metal (e.g., gold, silver, titanium, copper, brass, nickel, iron, nitinol), but can include other suitable materials (e.g., plastic, rubber, silicon), whether identical or non-identical to each other. The component 200 is rigid (e.g., cannot be bent or flexed manually by hand), but can be flexible (e.g., can be bent or flexed manually by hand). The component 200 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering). The base 202, at least one of the walls 204, or the bridge 206 is respectively monolithic with the base 202, at least one of the walls 204, or the bridge 206 (e.g., additively manufactured, subtractively manufactured, cast, injection molded), but can also be respectively assembled with the base 202, at least one of the walls 204, or the bridge 206 (e.g., fastening, mating, interlocking, hook-and-looping, magnetizing, adhering).

The component 200 can include a ring 208 looping around the bridge 206. The ring 208 enables a dangling component or a line or another jewelry object to be suspended therefrom. The ring 208 is not fixedly secured to the bridge 206 such that the ring 208 can moves relative to the bridge 206 when the wearer moves about. However, the ring 208 can also be fixedly secured to the bridge 206 (e.g., molded, adhered, magnetized) such that the ring 208 can avoid moving relative to the bridge 206 when the wearer moves about. The ring 208 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering).

The component 200 has a post 210 extending from the base 202. The post 210 is rectilinear, but can be arcuate, sinusoidal, or other suitable longitudinal extensions. The post 210 has a body portion (wider) and a shoulder portion (narrower), where the shoulder portion is configured for engagement (e.g., fastening, mating, interlocking, magnetizing, adhering) with the tubular member 106, as disclosed herein. The body portion extends through the ear of the wearer when the earring is worn, as disclosed herein. The post 210 includes a metal (e.g., gold, silver, titanium, copper, brass, nickel, iron, nitinol), but can include other suitable materials (e.g., plastic, rubber, silicon), whether identical or non-identical to each other. The post 210 is rigid (e.g., cannot be bent or flexed manually by hand), but can be flexible (e.g., can be bent or flexed manually by hand). The post 210 is a single monolithic piece (e.g., additively manufactured, subtractively manufactured, cast, injection molded), but can also be an assembly of pieces secured to each other (e.g., fastening, mating, interlocking, hook-and-looping, magnetizing, adhering). The post 210 is monolithic with the base 202 (e.g., additively manufactured, subtractively manufactured, cast, injection molded), but can also be assembled with the base 202 (e.g., fastening, mating, interlocking, hook-and-looping, magnetizing, adhering). Note that the post 210 can be fully smooth, fully threaded, partially smooth and partially threaded, uniform in width, or non-uniform in width (with shoulder).

Note that the earrings with the component 200 do not employ the arcuate member 104 (although that is possible). Therefore, the base 202 can extend from the post 210 such that the base 202, the walls 204, the bridge 206, or the ring 208 is respectively anatomically covered by the superior helix of the ear or the inferior antihelix crus of the ear such that the base 202, the walls 204, the bridge 206, or the ring 208 is respectively anatomically hidden by the superior helix of the ear or the inferior antihelix crus of the ear when the ear is viewed frontally straight-on.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. A method comprising:

causing an ear to be pierced such that a hole in a helix of the ear or a superior concha of the ear is formed, wherein the hole is respectively anatomically covered by a superior helix of the ear or an inferior antihelix crus of the ear such that the hole is respectively anatomically hidden by the superior helix of the ear or the inferior antihelix crus of the ear when the ear is viewed frontally straight-on;

causing a post of an earring to be inserted into the hole such that the earring is coupled to the ear via the post and the post is respectively anatomically hidden by the superior helix of the ear or the inferior antihelix crus of the ear when the ear is viewed frontally straight-on.

2. The method of claim 1, wherein causing the ear to be pierced includes causing the ear to be pierced such that the hole in the helix of the ear is formed, wherein the hole is anatomically covered by the superior helix of the ear such that the hole is anatomically hidden by the superior helix of the ear when the ear is viewed frontally straight-on, wherein the post is anatomically hidden by the superior helix of the ear when the ear is viewed frontally straight-on.

3. The method of claim 1, wherein causing the ear to be pierced including causing the ear to be pierced such that the hole in the superior concha of the ear is formed, wherein the hole is anatomically covered by the inferior antihelix crus of the ear such that the hole is anatomically hidden by the inferior antihelix crus of the ear when the ear is viewed frontally straight-on, wherein the post is anatomically hidden by the inferior antihelix crus of the ear when the ear is viewed frontally straight-on.

4. The method of claim 1, wherein the earring includes a member extending from the post such that the member is respectively anatomically covered by the superior helix of the ear or the inferior antihelix crus of the ear such that the member is respectively anatomically hidden by the superior helix of the ear or the inferior antihelix crus of the ear when the ear is viewed frontally straight-on.

5. The method of claim 4, wherein the earring includes a line suspended from the member such that the line is not respectively anatomically covered by the superior helix of the ear or the inferior antihelix crus of the ear such that the line is not respectively anatomically hidden by the superior helix of the ear or the inferior antihelix crus of the ear when the ear is viewed frontally straight-on.

6. The method of claim 5, wherein the line is not anatomically covered by the superior helix of the ear such that the line is not anatomically hidden by the superior helix of the ear when the ear is viewed frontally straight-on.

7. The method of claim 5, wherein the line is not anatomically covered by the inferior antihelix crus of the ear such that the line is not anatomically hidden by the inferior antihelix crus of the ear when the ear is viewed frontally straight-on.

8. The method of claim 5, wherein the member is an arcuate member.

9. The method of claim 5, wherein the line is parabolically suspended from the member such that the line has a parabolic vertex about which the line is symmetrical when suspended from the member, wherein the post extends from the member such that the post radially extends away from the parabolic vertex.

10. The method of claim 5, wherein the line is parabolically suspended from the member such that the line has a parabolic vertex about which the line is symmetrical when suspended from the member, wherein the post extends from the member such that the post laterally extends away from the parabolic vertex.

11. The method of claim 5, wherein the line is a chain.

12. The method of claim 5, wherein the earring has an object suspended from the line.

13. The method of claim 5, wherein the line is a first line, wherein the earring includes a second line suspended from the member.

14. The method of claim 13, wherein first line intersects the second line.

15. The method of claim 13, wherein the first line does not intersect the second line.

16. The method of claim 13, wherein the second line is parabolically suspended from the member.

17. The method of claim 4, wherein the member is tubular.

18. The method of claim 17, wherein the member is internally solid.

19. The method of claim 17, wherein the member is internally hollow.

20. The method of claim 4, wherein the member is flat.

21. The method of claim 4, wherein the member is a setting for a stone.

22. The method of claim 1, wherein the ear has an obverse side, wherein the post extends into a tube over the obverse side when the ear is viewed frontally straight-on.

23. The method of claim 22, wherein the post is secured to the tube when the post extends into the tube over the obverse side when the ear is viewed frontally straight-on.

24. The method of claim 1, wherein causing the ear to be pierced includes injecting a needle horizontally when the ear is viewed frontally straight-on.

25. The method of claim 1, wherein causing the ear to be pierced includes injecting a needle diagonally when the ear is viewed frontally straight-on.

26. The method of claim 1, wherein causing the ear to be pierced includes injecting a needle vertically when the ear is viewed frontally straight-on.

27. The method of claim 1, wherein the ear has an obverse side, wherein causing the ear to be pierced includes piercing the ear such that the hole exits on an eminentia conchae when the obverse side is viewed frontally straight-on.

* * * * *